US008319593B2

(12) United States Patent
Ke

(10) Patent No.: US 8,319,593 B2
(45) Date of Patent: Nov. 27, 2012

(54) SIGNAL TRANSFORMING CIRCUIT

(75) Inventor: Ling-Wei Ke, Hsinchu County (TW)

(73) Assignee: Mediatek Inc., Science-Based Industrial Park, Hsin-Chu (TW)

( * ) Notice: Subject to any disclaimer, the term of this patent is extended or adjusted under 35 U.S.C. 154(b) by 4 days.

(21) Appl. No.: 13/053,187

(22) Filed: Mar. 21, 2011

(65) Prior Publication Data

US 2012/0242406 A1 Sep. 27, 2012

(51) Int. Cl.
*H01F 21/02* (2006.01)
*H01F 5/00* (2006.01)

(52) U.S. Cl. ..... 336/145; 336/200

(58) Field of Classification Search ..... 336/145, 336/200, 223, 226, 232
See application file for complete search history.

(56) References Cited

U.S. PATENT DOCUMENTS 2,922,113 A * 1/1960 Hener et al. ..... 324/137
4,517,540 A * 5/1985 McDougal ..... 336/205
4,816,784 A * 3/1989 Rabjohn ..... 333/24 R
4,959,630 A * 9/1990 Yerman et al. ..... 336/83
5,134,770 A * 8/1992 Yerman et al. ..... 29/606
5,168,440 A * 12/1992 Spreen ..... 363/126
6,249,206 B1 * 6/2001 Uchikoba et al. ..... 336/200
6,636,140 B2 * 10/2003 Fujiyoshi et al. ..... 336/200
6,816,012 B2 11/2004 Aoki
7,049,819 B2 * 5/2006 Chan et al. ..... 324/319
7,088,214 B2 * 8/2006 Castaneda et al. ..... 336/200
7,471,153 B2 12/2008 Kee
7,796,007 B2 * 9/2010 Hopper et al. ..... 336/200
7,999,650 B2 * 8/2011 Mori ..... 336/200
8,008,987 B2 * 8/2011 Chen ..... 333/25
8,049,589 B2 * 11/2011 Chen ..... 336/200

* cited by examiner

*Primary Examiner* — Mohamad Musleh
*Assistant Examiner* — Joselito Baisa
(74) *Attorney, Agent, or Firm* — Winston Hsu; Scott Margo

(57) ABSTRACT

A signal transforming circuit includes: a first substantially 8-shaped geometry primary winding arranged to couple a first input signal; and a substantially 8-shaped geometry secondary winding having a first port and a second port, the substantially 8-shaped geometry secondary winding disposed adjacent to the first substantially 8-shaped geometry primary winding to magnetically couple to the first substantially 8-shaped geometry primary winding for generating an output signal at the first port and the second port.

33 Claims, 7 Drawing Sheets

SIGNAL TRANSFORMING CIRCUIT

BACKGROUND

The present invention relates to a signal transforming circuit, and more particularly to a signal transforming/combining circuit with far field cancellation.

The fast growing wireless market has created an urgent demand for smaller and cheaper handsets with increased functionality and performance. A major trend of circuit design is to incorporate as many circuit components into integrated circuit form as possible, whereby cost per wafer can be reduced. Inductors built in semiconductor wafers are widely used in CMOS based radio frequency (RF) circuits such as low-noise amplifiers, voltage-controlled oscillators, transformers, power combiners, and power amplifiers. An inductor is a passive electronic component that stores energy in the form of a magnetic field, and tends to resist any change in the amount of current flowing through it. When an inductor-based device, e.g., a power combiner, is implemented as a single-chip with other functional circuits, the inductor-based device may cause an interference problem. Specifically, if two inductor-based devices are installed in a single-chip transceiver, for example, at the same time, the inductor-based devices may produce undesired interaction due to various types of mutual coupling mechanisms. This may result in spurious receiver responses and unwanted frequencies in the transmission spectrum. The primary mutual coupling mechanism is usually the fundamental electromagnetic coupling between the two inductors in the two inductor-based devices respectively. In other words, to solve the interference problem, the two inductor-based devices in the single-chip should be isolated. Therefore, making a better isolation between two inductor-based devices in a single-chip to reduce the interference problem has become an important issue in the field of wireless communication systems.

SUMMARY

One of the objectives of the present invention is to therefore provide a signal transforming/combining circuit with far field cancellation.

According to an embodiment of the present invention, a signal transforming circuit is disclosed. The signal transforming circuit comprises a first substantially 8-shaped geometry primary winding and a substantially 8-shaped geometry secondary winding. The first substantially 8-shaped geometry primary winding is arranged to couple a first input signal. The substantially 8-shaped geometry secondary winding has a first port and a second port, and the substantially 8-shaped geometry secondary winding is disposed adjacent to the first substantially 8-shaped geometry primary winding to magnetically couple to the first substantially 8-shaped geometry primary winding for generating an output signal at the first port and the second port.

According to a second embodiment of the present invention, a signal transforming circuit is disclosed. The signal transforming circuit comprises a first substantially 8-shaped geometry primary winding, a substantially 8-shaped geometry secondary winding, a second substantially 8-shaped geometry primary winding, at least one first connection, and at least one second connection. The first substantially 8-shaped geometry primary winding comprises a first cyclic geometry winding and a second cyclic geometry winding arranged to couple a first input signal. The substantially 8-shaped geometry secondary winding, comprises a third cyclic geometry winding and a fourth cyclic geometry winding. The second substantially 8-shaped geometry primary winding comprises a fifth cyclic geometry winding and a sixth cyclic geometry winding arranged to couple a second input signal. The first connection is arranged to couple between the first cyclic geometry winding and the fifth cyclic geometry winding. The second connection is arranged to couple between the second cyclic geometry winding and the sixth cyclic geometry winding. The substantially 8-shaped geometry secondary winding is arranged to magnetically couple to the first substantially 8-shaped geometry primary winding and the second substantially 8-shaped geometry primary winding to generate an output signal.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections. In addition, as one of ordinary skill in the art will further appreciate, the term "operably coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. As one of ordinary skill in the art will also appreciate, inferred coupling (i.e., where one element is coupled to another element by inference) includes direct and indirect coupling between two elements in the same manner as "operably coupled".

Figure 1:
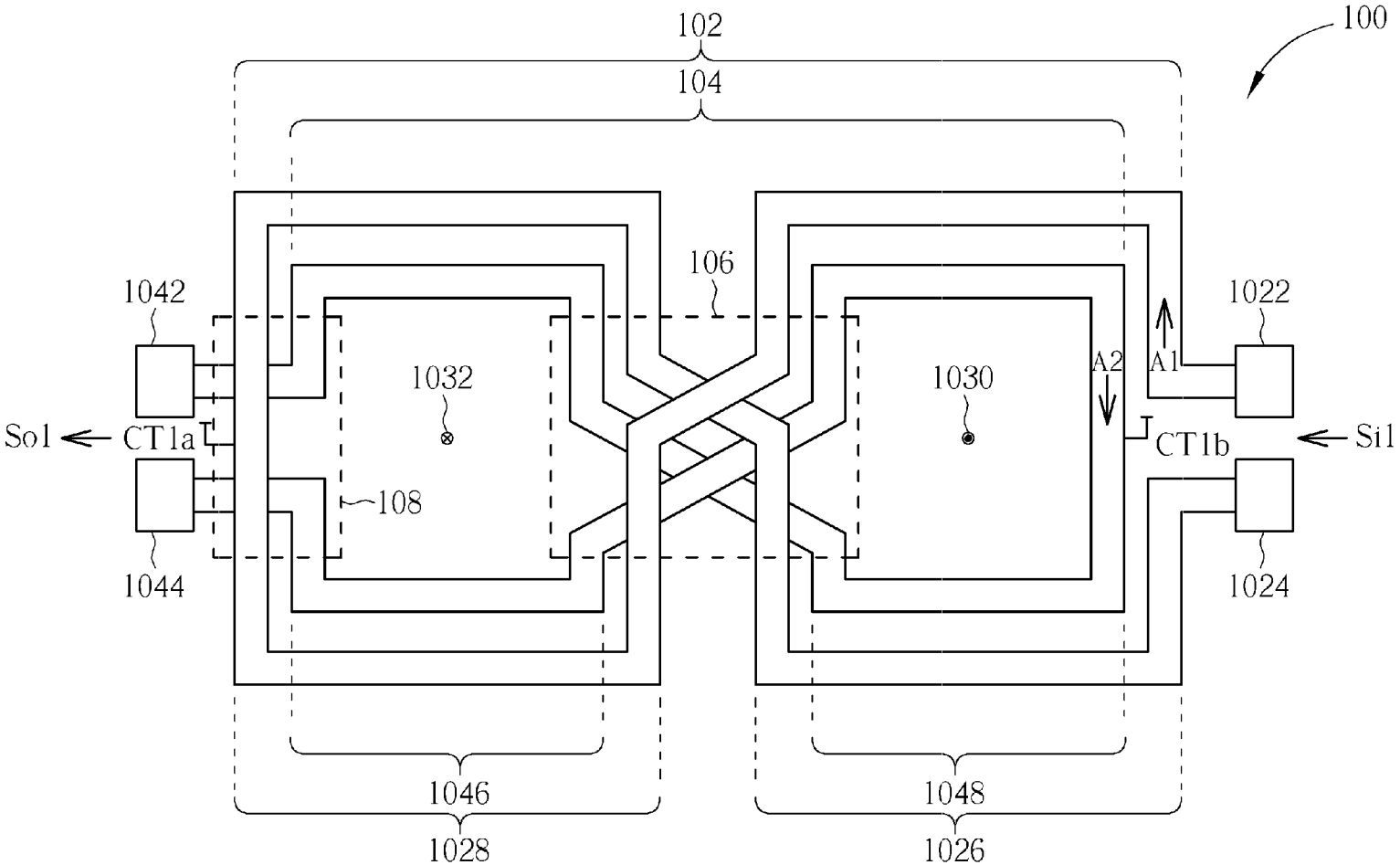
FIG. 1 is a diagram illustrating a signal transforming circuit according to a first exemplary embodiment of the present invention.

Please refer to FIG. 1. FIG. 1 is a diagram illustrating a signal transforming circuit 100 according to a first exemplary embodiment of the present invention. The signal transforming circuit 100 can be utilized to transform an input signal Si1 with an input power into an output signal So1 with an output power; therefore the signal transforming circuit 100 can also be called a transformer. The signal transforming circuit 100 comprises a substantially 8-shaped geometry primary winding 102 and a substantially 8-shaped geometry secondary winding 104. The substantially 8-shaped geometry primary winding 102 has a first port 1022 and a second port 1024 coupled for the input signal Si, and the substantially 8-shaped geometry secondary winding 104 has a first port 1042 and a second port 1044 arranged to generate the output signal So1 according to the input signal Si1. Specifically, the substantially 8-shaped geometry secondary winding 104 is disposed adjacent to the substantially 8-shaped geometry primary winding 102 to magnetically couple to the substantially 8-shaped geometry primary winding 102 for generating the output signal So1 at the first port 1042 and the second port 1044.

As shown in FIG. 1, the substantially 8-shaped geometry primary winding 102 further comprises a cyclic geometry winding 1026 and a cyclic geometry winding 1028. The term "cyclic geometry" is a geometry shape of a loop that the loop can be a circle, a square, a rectangular, or any other polygon. In addition, the cyclic geometry winding 1026 has a shape centered about a first axis 1030, and the cyclic geometry winding 1028 has a shape centered about a second axis 1032. For example, the cyclic geometry winding 1026 can be symmetrical about a first axis 1030, and the cyclic geometry winding 1028 can be symmetrical about a second axis 1032.

In this exemplary embodiment, the cyclic geometry winding 1026 and the cyclic geometry winding 1028 are arranged to form the substantially 8-shaped geometry primary winding 102 such that a magnetic field emanated by the cyclic geometry winding 1026 mutually electromagnetically couples with a magnetic field emanated by the cyclic geometry winding 1028. Furthermore, the substantially 8-shaped geometry secondary winding 104 comprises a cyclic geometry winding 1046 and a cyclic geometry winding 1048. The cyclic geometry winding 1046 has a shape centered about the second axis 1032, and the cyclic geometry winding 1048 has a shape centered about the first axis 1030, wherein the cyclic geometry winding 1046 and the cyclic geometry winding 1048 are arranged to form the substantially 8-shaped geometry secondary winding 104. In addition, the first axis 1030 is different from the second axis 1032, wherein the position of the first axis 1030 is substantially located in the middle of the cyclic geometry winding 1026 and the cyclic geometry winding 1048, and the position of the second axis 1032 is substantially located in the middle of the cyclic geometry winding 1028 and the cyclic geometry winding 1046 as shown in FIG. 1. It should be noted that the first axis 1030 and the second axis 1032 are just symbols rather than being an accurate illustration of the real element in the signal transforming circuit 100. The first axis 1030 and the second axis 1032 are merely shown for illustrating the structure of the signal transforming circuit 100.

In addition, when the input signal Si1 is inputted to the first port 1022 and the second port 1024, a current A1 will flow through the substantially 8-shaped geometry primary winding 102 from the first port 1022 to the second port 1024 (for example). The electromagnetic (EM) field components generated by the current A1 will induce a current A2 to flow through the substantially 8-shaped geometry secondary winding 104, as represented by the arrows shown in FIG. 1. Since the direction of the current A1 flowing in the cyclic geometry winding 1026 is counterclockwise and the direction of the current A1 flowing in the cyclic geometry winding 1028 is clockwise, the direction of the EM field components emanating in the space inside the cyclic geometry winding 1026 will point substantially outward from the surface, and the direction of the EM field components emanating in the space inside the cyclic geometry winding 1028 will point substantially inward from the surface as shown by the conventional notations (i.e., the first axis 1030 and the second axis 1032) in the middle of the cyclic geometry winding 1026 and the cyclic geometry winding 1028 respectively. In other words, the direction of the EM field components emanating in the space inside the cyclic geometry winding 1026 is opposite to the direction of the EM field components emanating in the space inside the cyclic geometry winding 1028. Moreover, the EM field components emanating at a certain distance from the cyclic geometry winding 1026 and the cyclic geometry winding 1028 also have opposite directions and tend to counteract each other. As a result, by making the cyclic geometry winding 1026 and the cyclic geometry winding 1028 substantially symmetrical, the far field generated by the substantially 8-shaped geometry primary winding 102 can be largely cancelled by itself while the substantially 8-shaped geometry primary winding 102 can still induce the current A2 to flow through the substantially 8-shaped geometry secondary winding 104 for transforming the input signal Si1 to generate the output signal So1.

It should be noted that the metal layer used for implementing the substantially 8-shaped geometry primary winding 102 may or may not be the same metal layer used for implementing the substantially 8-shaped geometry secondary winding 104. In this exemplary embodiment, the substantially 8-shaped geometry primary winding 102 and the substantially 8-shaped geometry secondary winding 104 are implemented on the same metal layer in the chip. However, the crossing area between the cyclic geometry winding 1026 and the cyclic geometry winding 1028, the crossing area between the cyclic geometry winding 1046 and the cyclic geometry winding 1048 (i.e., the portion labeled as 106), and the crossing area labeled as 108 can be routed to different metal layers to avoid the contact of the two different windings. In short, the metal layers on which the substantially 8-shaped geometry primary winding 102 and the substantially 8-shaped geometry secondary winding 104 are routed depend upon design requirements. In addition, it should be noted that the layout design shown in FIG. 1 is for illustrative purposes only, and is not meant to be a limitation of the present invention. That is, other alternative layout designs obeying the spirit of the present invention still fall within the scope of the present invention.

Furthermore, the center taps of the substantially 8-shaped geometry primary winding 102 and the substantially 8-shaped geometry secondary winding 104 are labeled as CT1*a* and CT1*b* respectively in FIG. 1. It should be noted that the center taps CT1*a*, CT1*b* are optional tap for the signal transforming circuit 100. When a center tap is added to the signal transforming circuit 100, a supply voltage Vdd, a ground voltage Vgnd, a common voltage, or any other DC (Direct Current) voltage, can be coupled to the center tap for providing the respective voltage thereon. Moreover, for example, when the center tap CT1*a* is added to a middle position of the substantially 8-shaped geometry primary winding 102, and the center tap CT1*a* is coupled to a common voltage, the substantially 8-shaped geometry primary winding 102 seems to be two inductors due to the common voltage applied at the middle position of the substantially 8-shaped geometry primary winding 102, wherein one inductor may be regarded as the partial conducting path between the center tap CT1*a* and the first port 1022, and the other inductor may be regarded as the partial conducting path between the center tap CT1*a* and the second port 1024. Accordingly, in the embodiments, equivalently two inductors can be obtained in one single conducting path by using the concept of center tap.

Figure 2:
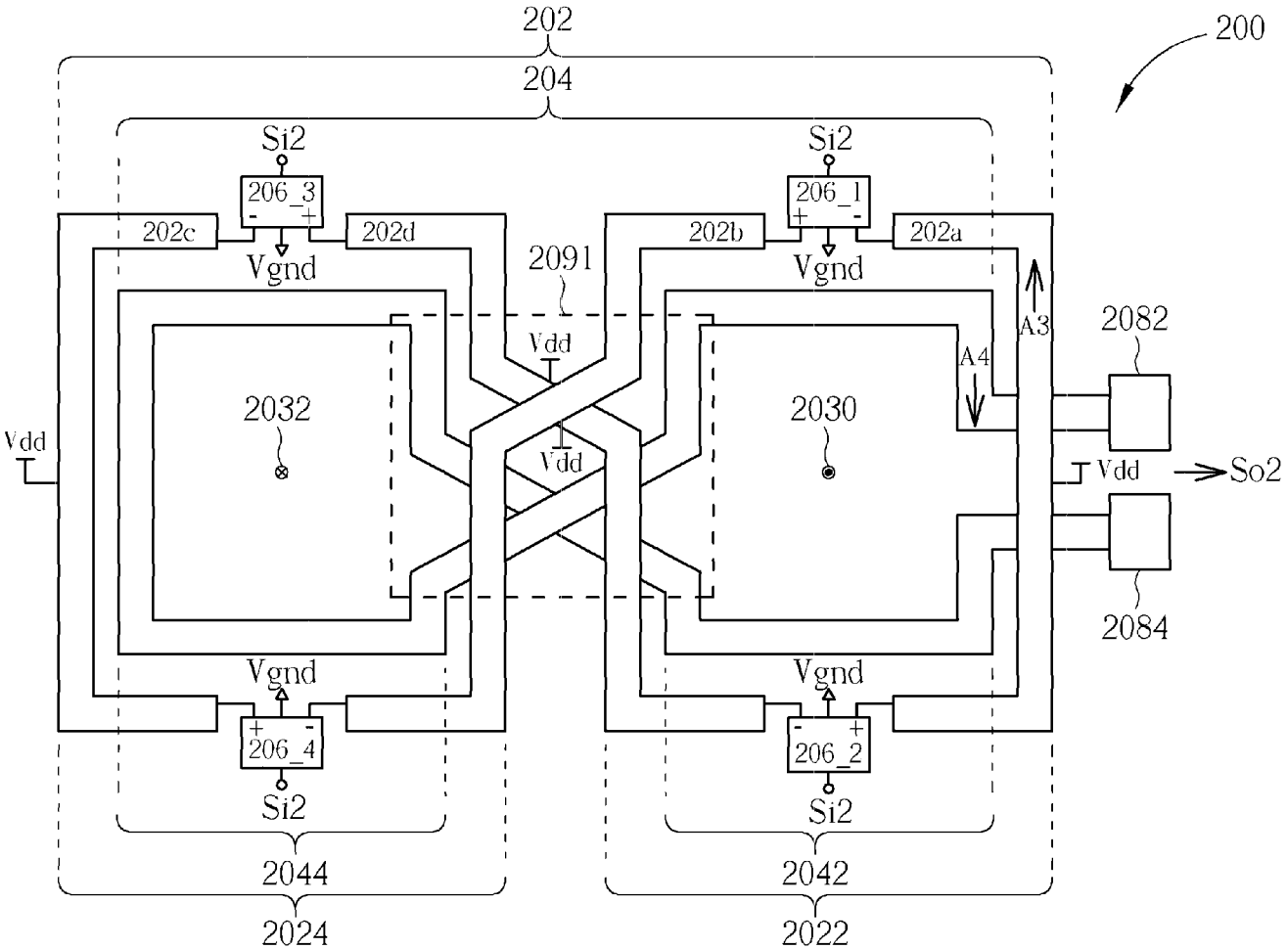
FIG. 2 is a diagram illustrating a signal transforming circuit according to a second exemplary embodiment of the present invention.

Please refer to FIG. 2. FIG. 2 is a diagram illustrating a signal transforming circuit 200 according to a second exemplary embodiment of the present invention. The signal transforming circuit 200 can be utilized to amplify an input signal Si2 with an input power into an output signal So2 with an output power, therefore the signal transforming circuit 200 can also be called a distributed active transformer (DAT) power amplifier. The signal transforming circuit 200 comprises a substantially 8-shaped geometry primary winding 202, a substantially 8-shaped geometry secondary winding 204, and a plurality of amplifiers 206_1 -206_4 receiving the input signal Si2.

The substantially 8-shaped geometry primary winding 202 comprises a first cyclic geometry winding 2022 and a second cyclic geometry winding 2024, wherein the first cyclic geometry winding 2022 and the second cyclic geometry winding 2024 are comprised of a plurality of inductive elements 202*a*-202*d*. The inductive element 202*a* and the inductive element 202*b* are coupled to an output port of the amplifier 206_1. The inductive element 202*a* and the inductive element 202*d* are coupled to an output port of the amplifier 206_2. The inductive element 202*c* and the inductive element 202*d* are coupled to an output port of the amplifier 206_3. The inductive element 202*c* and the inductive element 202*b* are coupled to an output port of the amplifier 206_4.

As shown in FIG. 2, the first cyclic geometry winding 2022 having a shape centered about a first axis 2030 is formed by the inductive element 202*a*, a partial of the inductive element 202*b*, and a partial of the inductive element 202*d*. The first cyclic geometry winding 2024 having a shape symmetrical about a second axis 2032 is formed by the inductive element 202*c*, a partial of the inductive element 202*d*, and a partial of the inductive element 202*b*. In addition, the first cyclic geometry winding 2022 and the second cyclic geometry winding 2024 are arranged to form the substantially 8-shaped geometry primary winding 202 such that a magnetic field emanated by the first cyclic geometry winding 2022 mutually electromagnetically couples with a magnetic field emanated by the second cyclic geometry winding 2024.

Furthermore, the substantially 8-shaped geometry secondary winding 204 comprises a first cyclic geometry winding 2042 and a second cyclic geometry winding 2044. As shown in FIG. 2, the first cyclic geometry winding 2042 is arranged to have a shape centered about the first axis 2030, and the second cyclic geometry winding 2044 is arranged to have a shape centered about the second axis 2032. Furthermore, the first cyclic geometry winding 2042 and the second cyclic geometry winding 2044 are arranged to form the substantially 8-shaped geometry secondary winding 204. In addition, the substantially 8-shaped geometry secondary winding 204 further comprises a first port 2082 and a second port 2084 arranged to generate the output signal So2 according to the input signal Si2. Specifically, the substantially 8-shaped geometry secondary winding 204 is disposed adjacent to the substantially 8-shaped geometry primary winding 202 to magnetically couple to the substantially 8-shaped geometry primary winding 202 for generating the output signal So2 at the first port 2082 and the second port 2084.

In addition, each amplifier of the plurality of amplifiers 206_1-206_4 is a push-pull amplifier having a positive output terminal (+) and a negative output terminal (−), wherein the positive output terminal (+) and negative output terminal (−) are coupled to their respective inductive element as shown in FIG. 2. Furthermore, each amplifier of the plurality of amplifiers 206_1-206_4 has an input port receiving the input signal Si2. It should be noted that the input signal Si2 is a differential input signal and therefore each of the input ports is a differential input port having a positive input terminal and a negative input terminal (not shown). Therefore, each amplifier of the plurality of amplifiers 206_1-206_4 has a common mode terminal coupled to the ground voltage Vgnd. A supply voltage Vdd is coupled to the substantially middle position (i.e., center tap) of each inductive element of the inductive elements 202*a*-202*d* as shown in FIG. 2. It should be noted that another center tap(s) (not shown) may be arranged to couple to the substantially middle position of the substantially 8-shaped geometry secondary winding 204 to provide a DC voltage.

According to the topology of the substantially 8-shaped geometry primary winding 202, when the input signal Sit is inputted to the amplifiers 206_1-206_4, each distributed amplifier is able to create an individual radiating RF power outputs. Then, by appropriately tuning the impedance matching condition between the output port of each amplifier and the corresponding inductive element and the phases of the input signal Si2, the power outputs can be combined to provide a single output that is essentially the sum of the individual power outputs. More specifically, the amplifiers 206_1-206_4 in conjunction with the inductive elements 202*a*-202*d* form the substantially 8-shaped geometry winding that is used as the primary circuit of a magnetically coupled active transformer to combine the output power of the four amplifiers 206_1-206_4. Then, a uniform cyclic current A3 (i.e., the arrows as shown in FIG. 2) at the fundamental frequency around the substantially 8-shaped geometry winding is generated and the uniform cyclic current results in a strong magnetic flux through the substantially 8-shaped geometry winding.

Then, the electromagnetic (EM) field components generated by the current A3 will induce a current A4 (i.e., the arrows as shown in FIG. 2) to flow through the substantially 8-shaped geometry secondary winding 204. Since the direction of the current A3 flowing in the first cyclic geometry winding 2022 is counterclockwise and the direction of the current A3 flowing in the second cyclic geometry winding 2024 is clockwise, the direction of the EM field components emanating in the space inside the first cyclic geometry winding 2022 will point substantially outward from the surface, and the direction of the EM field components emanating in the space inside the second cyclic geometry winding 2024 will point substantially inward from the surface as shown by the conventional notations (i.e., the first axis 2030 and the second axis 2032) in the middle of the first cyclic geometry winding 2022 and the second cyclic geometry winding 2024 respectively. In other words, the direction of the EM field components emanating in the space inside the first cyclic geometry winding 2022 is opposite to the direction of the EM field components emanating in the space inside the second cyclic geometry winding 2024. Moreover, the EM field components emanating at a certain distance from the first cyclic geometry winding 2022 and the second cyclic geometry winding 2024 also have opposite directions and tend to counteract each other. As a result, by making the first cyclic geometry winding 2022 and the second cyclic geometry winding 2024 substantially symmetrical, the far field generated by the substantially 8-shaped geometry primary winding 202 can be largely cancelled by itself while the substantially 8-shaped geometry primary winding 202 can still induce the current A4 to flow through the substantially 8-shaped geometry secondary winding 204 for amplifying the input signal Sit to generate the output signal Sot.

In this exemplary embodiment, the substantially 8-shaped geometry primary winding 202 and the substantially 8-shaped geometry secondary winding 204 are implemented on the same metal layer in the chip. However, the crossing area between the first cyclic geometry winding 2022 and the second cyclic geometry winding 2024, the crossing area between the first cyclic geometry winding 2042 and the second cyclic geometry winding 2044 (i.e., the portion labeled as 2091), and the crossing area labeled as 2092 can be routed to different metal layers to avoid the contact of the two different windings. In short, the metal layers on which the substantially 8-shaped geometry primary winding 202 and the substantially 8-shaped geometry secondary winding 204 are routed depend upon design requirements. In addition, it should be noted that the layout design shown in FIG. 2 is for illustrative purposes only, and is not meant to be a limitation of the present invention. That is to say, other alternative layout designs obeying the spirit of the present invention still fall within the scope of the present invention.

Figure 3A:
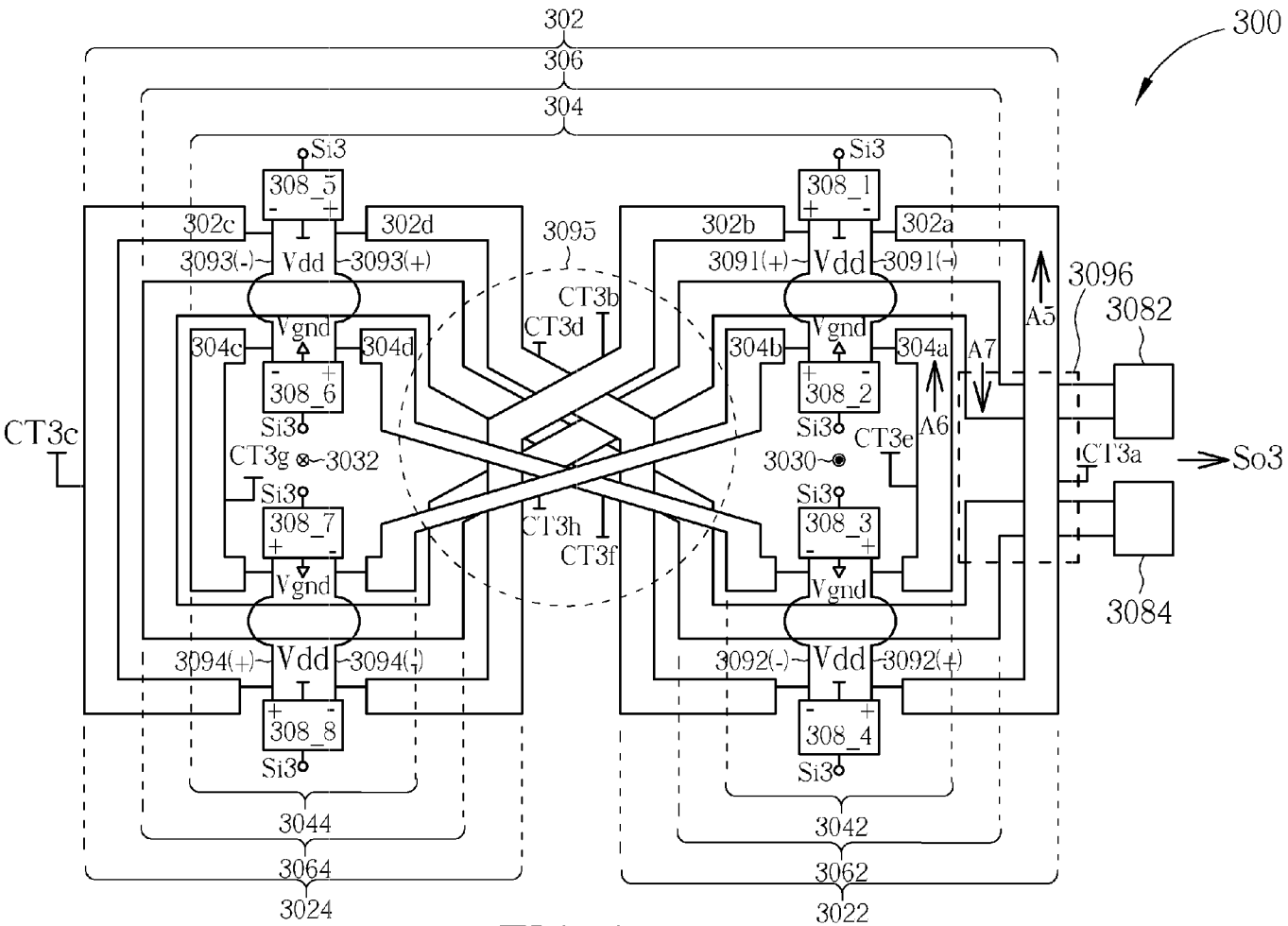
FIG. 3A is a diagram illustrating a signal transforming circuit according to a third exemplary embodiment of the present invention.

Please refer to FIG. 3A. FIG. 3A is a diagram illustrating a signal transforming circuit 300 according to a third exemplary embodiment of the present invention. The signal transforming circuit 300 can be utilized to amplify an input signal Si3 with an input power into an output signal So3 with an output power, therefore the signal transforming circuit 300 can also be called a distributed active transformer (DAT) power amplifier. The signal transforming circuit 300 comprises a first substantially 8-shaped geometry primary winding 302, a second substantially 8-shaped geometry primary winding 304, a substantially 8-shaped geometry secondary winding 306, and a plurality of amplifiers 308_1-308_8 receiving the input signal Si3.

The first substantially 8-shaped geometry primary winding 302 comprises a first cyclic geometry winding 3022 and a second cyclic geometry winding 3024, wherein the first cyclic geometry winding 3022 and the second cyclic geometry winding 3024 are comprised of a plurality of inductive elements 302*a*-302*d*. The inductive element 302*a* and the inductive element 302*b* are coupled to an output port of the amplifier 308_1. The inductive element 302*a* and the inductive element 302*d* are coupled to an output port of the amplifier 308_4. The inductive element 302*c* and the inductive element 302*d* are coupled to an output port of the amplifier 308_5. The inductive element 302*c* and the inductive element 302*b* are coupled to an output port of the amplifier 308_8.

The second substantially 8-shaped geometry primary winding 304 comprises a first cyclic geometry winding 3042 and a second cyclic geometry winding 3044, wherein the first cyclic geometry winding 3042 and the second cyclic geometry winding 3044 are comprised of a plurality of inductive elements 304*a*-304*d*. The inductive element 304*a* and the inductive element 304*b* are coupled to an output port of the amplifier 308_2. The inductive element 304*a* and the inductive element 304*d* are coupled to an output port of the amplifier 308_3. The inductive element 304*c* and the inductive element 304*d* are coupled to an output port of the amplifier 308_6. The inductive element 304*c* and the inductive element 304*b* are coupled to an output port of the amplifier 308_7.

As shown in FIG. 3A, the first cyclic geometry winding 3022 having a shape centered about a first axis 3030 is formed by the inductive element 302*a*, a partial of the inductive element 302*b*, and a partial of the inductive element 302*d*. The second cyclic geometry winding 3024 having a shape centered about a second axis 3032 is formed by the inductive element 302*c*, a partial of the inductive element 302*d*, and a partial of the inductive element 302*b*. In addition, the first cyclic geometry winding 3022 and the second cyclic geometry winding 3024 are arranged to form the first substantially 8-shaped geometry primary winding 302 such that a magnetic field emanated by the first cyclic geometry winding 3022 mutually electromagnetic couples with a magnetic field emanated by the second cyclic geometry winding 3024.

The first cyclic geometry winding 3042 having a shape centered about the first axis 3030 is formed by the inductive element 304*a*, a partial of the inductive element 304*b*, and a partial of the inductive element 304*d*. The second cyclic geometry winding 3044 having a shape centered about the second axis 3032 is formed by the inductive element 304*c*, a partial of the inductive element 304*d*, and a partial of the inductive element 304*b*. In addition, the first cyclic geometry winding 3042 and the second cyclic geometry winding 3044 are arranged to form the second substantially 8-shaped geometry primary winding 304 such that a magnetic field emanated by the first cyclic geometry winding 3042 mutually electromagnetic couples with a magnetic field emanated by the second cyclic geometry winding 3044.

Furthermore, the substantially 8-shaped geometry secondary winding 306 comprises a first cyclic geometry winding 3062 and a second cyclic geometry winding 3064. As shown in FIG. 3A, the first cyclic geometry winding 3062 is arranged to have a shape centered about the first axis 3030, and the second cyclic geometry winding 3064 is arranged to have a shape centered about the second axis 3032. Furthermore, the first cyclic geometry winding 3062 and the second cyclic geometry winding 3064 are arranged to form the substantially 8-shaped geometry secondary winding 306. In addition, the substantially 8-shaped geometry secondary winding 306 further comprises a first port 3082 and a second port 3084 arranged to generate the output signal So3 according to the input signal Si3. Specifically, the substantially 8-shaped geometry secondary winding 306 is disposed adjacent to the first substantially 8-shaped geometry primary winding 302 and the second substantially 8-shaped geometry primary winding 304 to magnetically couple to the first substantially 8-shaped geometry primary winding 302 and the second substantially 8-shaped geometry primary winding 304 to generate the output signal So3 at the first port 3082 and the second port 3084. Moreover, a plurality of center taps CT3*a*-CT3*h* may be added to the inductive elements 304*a*, 302*b*, 302*c*, 302*d*, 304*a*, 304*b*, 304*c*, 304*d* respectively as shown in FIG. 3A, and the functions of the center taps have been described in the above embodiment, thus the detailed description is omitted here for brevity. It should be noted that another center tap(s) (not shown) may be arranged to couple to the substantially middle position of the substantially 8-shaped geometry secondary winding 306 to provide a DC voltage.

Figure 3B:
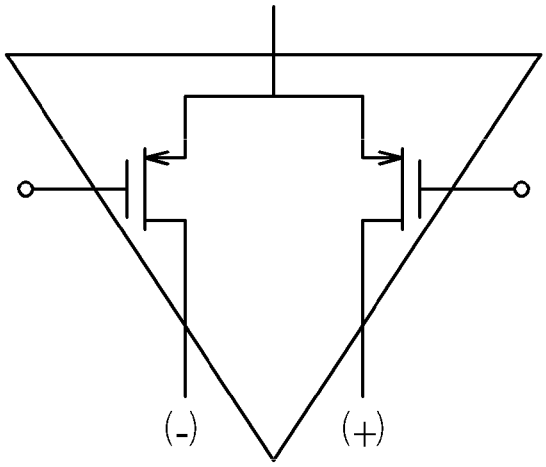
FIG. 3B is a diagram illustrating a P-type complementary amplifier according to an embodiment of the present invention.
Figure 3C:
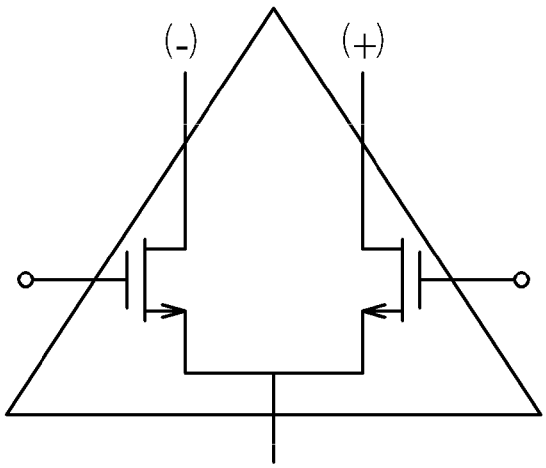
FIG. 3C is a diagram illustrating an N-type complementary amplifier according to an embodiment of the present invention.

In addition, each amplifier of the plurality of amplifiers 308_1-308_8 is a push-pull amplifier having a positive output terminal (+) and a negative output terminal (−), wherein the positive output terminal (+) and negative output terminal (−) are coupled to their respective inductive element as shown in FIG. 3A. Furthermore, each amplifier of the plurality of amplifiers 308_1-308_8 has an input port receiving the input signal Si3. It should be noted that the input signal Si3 is a differential input signal and therefore each of the input ports is a differential input port having a positive input terminal and a negative input terminal (not shown). In addition, each amplifier of the amplifiers 308_1, 308_4, 308_5, 308_8 has a common mode terminal coupled to the supply voltage Vdd, and each amplifier of the amplifiers 308_2, 308_3, 308_6, 308_7 has a common mode terminal coupled to the ground voltage Vgnd as shown in FIG. 3B and FIG. C. FIG. 3B is a diagram illustrating the amplifier 308_1 according to an embodiment of the present invention. FIG. 3C is a diagram illustrating the amplifier 308_2 according to an embodiment of the present invention. It should be noted that, the configuration of other amplifier pairs (e.g., the amplifiers 308_3-308_4, 308_5-308_6, 308_7-308_8) are similar to the amplifiers 308_1-308_2, therefore the detailed description of the other amplifier pairs is omitted here for brevity. The amplifier 308_1 is a P-type complementary amplifier having a P-type transistor pair for receiving the input signal Si3. The amplifier 308_2 is an N-type complementary amplifier having an N-type transistor pair for receiving the input signal Si3. By using P-type circuits for the amplifying entities connected to the supply voltage Vdd and n-type circuits for the amplifying entities connected to ground voltage Vgnd, the various bias signals and control signals, such as amplifier inputs, will typically be at voltages which are greater than the supply and less than ground. This configuration reduces the difficulty of providing these bias and control signals.

Furthermore, in this embodiment, the positive output (+) of the amplifier 308_1 is coupled to the positive output (+) of the amplifier 308_2, and the negative output (−) of the amplifier 308_1 is coupled to the negative output (−) of the amplifier 308_2. The positive output (+) of the amplifier 308_3 is coupled to the positive output (+) of the amplifier 308_4, and the negative output (−) of the amplifier 308_3 is coupled to the negative output (−) of the amplifier 308_4. The positive output (+) of the amplifier 308_5 is coupled to the positive output (+) of the amplifier 308_6, and the negative output (−) of the amplifier 308_5 is coupled to the negative output (−) of the amplifier 308_6. The positive output (+) of the amplifier 308_7 is coupled to the positive output (+) of the amplifier 308_8, and the negative output (−) of the amplifier 308_7 is coupled to the negative output (−) of the amplifier 308_8. Therefore, the signal transforming circuit 300 further comprises a plurality of connections 3091(+), (−)-3094(+), (−), wherein the connections 3091(+), 3091(−) are arranged to couple between the output ports of the amplifier 308_1 and the amplifier 308_2, the connections 3092(+), 3092(−) are arranged to couple between the output ports of the amplifier 308_3 and the amplifier 308_4, the connections 3093(+), 3093(−) are arranged to couple between the output ports of the amplifier 308_5 and the amplifier 308_6, and the connections 3094(+), 3094(−) are arranged to couple between the output ports of the amplifier 308_7 and the amplifier 308_8. More specifically, the connections 3091(+), 3091(−) are arranged to conduct a dc current from the supply voltage Vdd of the amplifier 308_1 to the ground voltage Vgnd of the amplifier 308_2, the connections 3092(+), 3092(−) are arranged to conduct a dc current from the supply voltage Vdd of the amplifier 308_3 to the ground voltage Vgnd of the amplifier 308_4, the connections 3093(+), 3093(−) are arranged to conduct a dc current from the supply voltage Vdd of the amplifier 308_5 to the ground voltage Vgnd of the amplifier 308_6, and the connections 3094(+), 3094(−) are arranged to conduct a dc current from the supply voltage Vdd of the amplifier 308_7 to the ground voltage Vgnd of the amplifier 308_8. Therefore, the pair of amplifiers (e.g., the amplifier 308_1 and the amplifier 308_2) shares their dc supply currents in a series fashion.

According to the topology of the first substantially 8-shaped geometry primary winding 302 and the second substantially 8-shaped geometry primary winding 304, when the input signal Si3 is inputted to the amplifiers 308_1-308_8, each distributed amplifier is able to create an individual radiating RF power outputs. Then, by appropriately tuning the impedance matching condition between the output port of each amplifier and the corresponding inductive element and the phases of the input signal Si3, the power outputs can be combined to provide a single output that is essentially the sum of the individual power outputs. More specifically, the amplifiers 308_1, 308_4, 308_5, 308_8 in conjunction with the inductive elements 302*a*-302*d* form the substantially 8-shaped geometry winding that is used as the first primary circuit of a magnetically coupled active transformer to combine the output power of the four amplifiers 308_1, 308_4, 308_5, 308_8. The amplifiers 308_2, 308_3, 308_6, 308_7 in conjunction with the inductive elements 304*a*-304*d* form the substantially 8-shaped geometry winding that is used as the second primary circuit of a magnetically coupled active transformer to combine the output power of the four amplifiers 308_2, 308_3, 308_6, 308_7. Then, a uniform cyclic current A5 (i.e., the arrows as shown in FIG. 3A) at the fundamental frequency around the first substantially 8-shaped geometry winding is generated and the uniform cyclic current results in a strong magnetic flux through the first substantially 8-shaped geometry winding, and a uniform cyclic current A6 (i.e., the arrows as shown in FIG. 3A) at the fundamental frequency around the second substantially 8-shaped geometry winding is generated and the uniform cyclic current results in a strong magnetic flux through the second substantially 8-shaped geometry winding.

The electromagnetic (EM) field components generated by the currents A5 and A6 will induce a current A7 (i.e., the arrows as shown in FIG. 3A) to flow through the substantially 8-shaped geometry secondary winding 306. Since the direction of the currents A5 and A6 flowing in the first cyclic geometry windings 3022 and 3042 is counterclockwise and the direction of the currents A5 and A6 flowing in the second cyclic geometry windings 3024 and 3044 is clockwise, the direction of the EM field components emanating in the space inside the first cyclic geometry windings 3022 and 3042 will point substantially outward from the surface, and the direction of the EM field components emanating in the space inside the second cyclic geometry windings 3024 and 3044 will point substantially inward from the surface as shown by the conventional notations (i.e., the first axis 3030 and the second axis 3032) in the middle of the first cyclic geometry winding 3022 and the second cyclic geometry winding 3024 respectively. In other words, the direction of the EM field components emanating in the space inside the first cyclic geometry windings 3022 is opposite to the direction of the EM field components emanating in the space inside the second cyclic geometry winding 3024. Moreover, the EM field components emanating at a certain distance from the first cyclic geometry winding 3022 and the second cyclic geometry winding 3024 also have opposite directions and tend to counteract each other. As a result, by making the first cyclic geometry winding 3022 and the second cyclic geometry winding 3024 substantially symmetrical, and making the first cyclic geometry winding 3042 and the second cyclic geometry winding 3044 substantially symmetrical, the far field generated by the first substantially 8-shaped geometry primary winding 302 and the second substantially 8-shaped geometry primary winding 304 can be largely cancelled by itself while the first substantially 8-shaped geometry primary winding 302 and the second substantially 8-shaped geometry primary winding 304 can still induce the current A7 to flow through the substantially 8-shaped geometry secondary winding 306 for amplifying the input signal Si3 to generate the output signal So3.

In this exemplary embodiment, the first substantially 8-shaped geometry primary winding 302, the second substantially 8-shaped geometry primary winding 304, and the substantially 8-shaped geometry secondary winding 306 are implemented on the same metal layer in the chip. However, the crossing area between the first cyclic geometry winding 3022 and the second cyclic geometry winding 3024, the crossing area between the first cyclic geometry winding 3042 and the second cyclic geometry winding 3044, the crossing area between the first cyclic geometry winding 3062 and the second cyclic geometry winding 3064 (i.e., the portion labeled as 3095), and the crossing area labeled as 3096 can be routed to different metal layers to avoid the contact of the two different windings. In short, the metal layers on which the first substantially 8-shaped geometry primary winding 302, the second substantially 8-shaped geometry primary winding 304, and the substantially 8-shaped geometry secondary winding 306 are routed depend upon design requirements. In addition, it should be noted that the layout design shown in FIG. 3A is for illustrative purposes only, and is not meant to be a limitation of the present invention. That is, other alternative layout designs obeying the spirit of the present invention still fall within the scope of the present invention.

Figure 4:
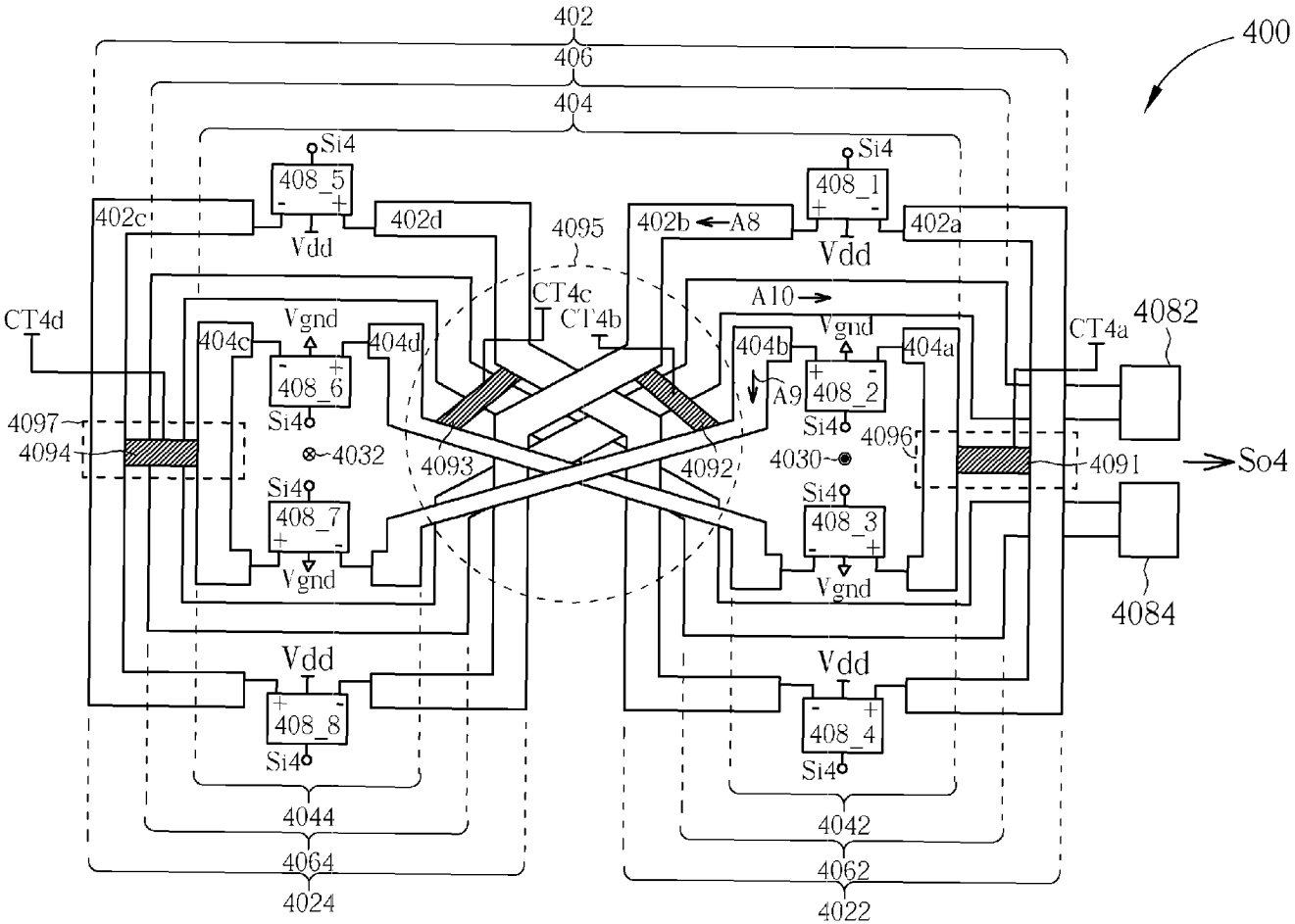
FIG. 4 is a diagram illustrating a signal transforming circuit according to a fourth exemplary embodiment of the present invention.

Please refer to FIG. 4. FIG. 4 is a diagram illustrating a signal transforming circuit 400 according to a fourth exemplary embodiment of the present invention. The signal transforming circuit 400 can be utilized to amplify an input signal Si4 with an input power into an output signal So4 with an output power, therefore the signal transforming circuit 400 can also be called a distributed active transformer (DAT) power amplifier. The signal transforming circuit 400 comprises a first substantially 8-shaped geometry primary winding 402, a second substantially 8-shaped geometry primary winding 404, a substantially 8-shaped geometry secondary winding 406, and a plurality of amplifiers 408_1-408_8 receiving the input signal Si4. It should be noted that, the configuration of amplifier pairs (e.g., the amplifiers 408_1-408_2, 408_3-408_4, 408_5-408_6, 408_7-408_8) are similar to the amplifiers 308_1-308_2 as shown in FIG. 3B-3C, therefore the detailed description of the amplifier pairs is omitted here for brevity.

The first substantially 8-shaped geometry primary winding 402 comprises a first cyclic geometry winding 4022 and a second cyclic geometry winding 4024, wherein the first cyclic geometry winding 4022 and the second cyclic geometry winding 4024 are comprised of a plurality of inductive elements 402*a*-402*d*. The inductive element 402*a* and the inductive element 402*b* are coupled to an output port of the amplifier 408_1. The inductive element 402*a* and the inductive element 402*d* are coupled to an output port of the amplifier 408_4. The inductive element 402*c* and the inductive element 402*d* are coupled to an output port of the amplifier 408_5. The inductive element 402*c* and the inductive element 402*b* are coupled to an output port of the amplifier 408_8.

The second substantially 8-shaped geometry primary winding 404 comprises a first cyclic geometry winding 4042 and a second cyclic geometry winding 4044, wherein the first cyclic geometry winding 4042 and the second cyclic geometry winding 4044 are comprised of a plurality of inductive elements 404*a*-404*d*. The inductive element 404*a* and the inductive element 404*b* are coupled to an output port of the amplifier 408_2. The inductive element 404*a* and the inductive element 404*d* are coupled to an output port of the amplifier 408_3. The inductive element 404*c* and the inductive element 404*d* are coupled to an output port of the amplifier 408_6. The inductive element 404*c* and the inductive element 404*b* are coupled to an output port of the amplifier 408_7.

As shown in FIG. 4, the first cyclic geometry winding 4022 having a shape centered about a first axis 4030 is formed by the inductive element 402*a*, a partial of the inductive element 402*b*, and a partial of the inductive element 402*d*. The second cyclic geometry winding 4024 having a shape centered about a second axis 4032 is formed by the inductive element 402*c*, a partial of the inductive element 402*d*, and a partial of the inductive element 402*b*. In addition, the first cyclic geometry winding 4022 and the second cyclic geometry winding 4024 are arranged to form the first substantially 8-shaped geometry primary winding 402 such that a magnetic field emanated by the first cyclic geometry winding 4022 mutually electromagnetically couples with a magnetic field emanated by the second cyclic geometry winding 4024.

The first cyclic geometry winding 4042 having a shape centered about the first axis 4030 is formed by the inductive element 404*a*, a partial of the inductive element 404*b*, and a partial of the inductive element 404*d*. The second cyclic geometry winding 4044 having a shape centered about the second axis 4032 is formed by the inductive element 404*c*, a partial of the inductive element 404*d*, and a partial of the inductive element 404*b*. In addition, the first cyclic geometry winding 4042 and the second cyclic geometry winding 4044 are arranged to form the second substantially 8-shaped geometry primary winding 404 such that a magnetic field emanated by the first cyclic geometry winding 4042 mutually electromagnetically couples with a magnetic field emanated by the second cyclic geometry winding 4044.

Furthermore, the substantially 8-shaped geometry secondary winding 406 comprises a first cyclic geometry winding 4062 and a second cyclic geometry winding 4064. As shown in FIG. 4, the first cyclic geometry winding 4062 is arranged to have a shape centered about the first axis 4030, and the second cyclic geometry winding 4064 is arranged to have a shape centered about the second axis 4032. Furthermore, the first cyclic geometry winding 4062 and the second cyclic geometry winding 4064 are arranged to form the substantially 8-shaped geometry secondary winding 406. In addition, the substantially 8-shaped geometry secondary winding 406 further comprises a first port 4082 and a second port 4084 arranged to generate the output signal So4 according to the input signal Si4. Specifically, the substantially 8-shaped geometry secondary winding 406 is disposed adjacent to the first substantially 8-shaped geometry primary winding 402 and the second substantially 8-shaped geometry primary winding 404 to magnetically couple to the first substantially 8-shaped geometry primary winding 402 and the second substantially 8-shaped geometry primary winding 404 to generate the output signal So4 at the first port 4082 and the second port 4084.

In addition, each amplifier of the plurality of amplifiers 408_1-408_8 is a push-pull amplifier having a positive output terminal (+) and a negative output terminal (−), wherein the positive output terminal (+) and are negative output terminal (−) coupled to the respective inductive element as shown in FIG. 4. Furthermore, each amplifier of the plurality of amplifiers 408_1-408_8 has an input port receiving the input signal Si4. It should be noted that the input signal Si4 is a differential input signal and therefore each of the input ports is a differential input port having a positive input terminal and a negative input terminal (not shown). In addition, each amplifier of the amplifiers 408_1, 408_4, 408_5, 408_8 has a common mode terminal coupled to the supply voltage Vdd, and each amplifier of the amplifiers 408_2, 408_3, 408_6, 408_7 has a common mode terminal coupled to the ground voltage Vgnd as shown in FIG. 4.

Furthermore, the signal transforming circuit 400 further comprises a plurality of connections 4091-4094 (i.e., the oblique line inductive elements). Specifically, a first node of the connection 4091 is arranged to attach to the inductive element 402*a* at a position on the first cyclic geometry winding 4022 where a voltage waveform of a fundamental frequency is at a minimum (e.g., a virtual ground), and a second node of the connection 4091 is arranged to attach to the inductive element 404*a* at a position on the first cyclic geometry winding 4042 where a voltage waveform of a fundamental frequency is at a minimum. A first node of the connection 4092 is arranged to attach to the inductive element 402*b* at a position on the first cyclic geometry winding 4022 where a voltage waveform of a fundamental frequency is at a minimum, and a second node of the connection 4092 is arranged to attach to the inductive element 404*b* at a position on the first cyclic geometry winding 4042 where a voltage waveform of a fundamental frequency is at a minimum. A first node of the connection 4093 is arranged to attach to the inductive element 402*d* at a position on the second cyclic geometry winding 4024 where a voltage waveform of a fundamental frequency is at a minimum, and a second node of the connection 4093 is arranged to attach to the inductive element 404*d* at a position on the second cyclic geometry winding 4044 where a voltage waveform of a fundamental frequency is at a minimum. A first node of the connection 4094 is arranged to attach to the inductive element 402*c* at a position on the second cyclic geometry winding 4024 where a voltage waveform of a fundamental frequency is at a minimum, and a second node of the connection 4094 is arranged to attach to the inductive element 404*c* at a position on the second cyclic geometry winding 4044 where a voltage waveform of a fundamental frequency is at a minimum. More specifically, the connection 4091 is arranged to conduct a dc current from the supply voltage Vdd of the amplifier 408_1 to the ground voltage Vgnd of the amplifier 408_2, and conduct a dc current from the supply voltage Vdd of the amplifier 408_4 to the ground voltage Vgnd of the amplifier 408_3. The connection 4092 is arranged to conduct a dc current from the supply voltage Vdd of the amplifier 408_1 to the ground voltage Vgnd of the amplifier 408_2, and conduct a dc current from the supply voltage Vdd of the amplifier 408_8 to the ground voltage Vgnd of the amplifier 408_7. The connection 4093 is arranged to conduct a dc current from the supply voltage Vdd of the amplifier 408_5 to the ground voltage Vgnd of the amplifier 408_6, and conduct a dc current from the supply voltage Vdd of the amplifier 408_8 to the ground voltage Vgnd of the amplifier 408_7. The connection 4094 is arranged to conduct a dc current from the supply voltage Vdd of the amplifier 408_5 to the ground voltage Vgnd of the amplifier 408_6, and conduct a dc current from the supply voltage Vdd of the amplifier 408_4 to the ground voltage Vgnd of the amplifier 408_3. Accordingly, a benefit of making the supply connections in this way is that the dc current consumed by the amplifiers on the first substantially 8-shaped geometry primary winding 402 is shared with the amplifiers on the second substantially 8-shaped geometry primary winding 404.

According to the topology of the first substantially 8-shaped geometry primary winding 402 and the second substantially 8-shaped geometry primary winding 404, when the input signal Si4 is inputted to the amplifiers 408_1-408_8, each distributed amplifier is able to create an individual radiating RF power outputs. Then, by appropriately tuning the impedance matching condition between the output port of each amplifier and the corresponding inductive element and the phases of the input signal Si4, the power outputs can be combined to provide a single output that is essentially the sum of the individual power outputs. More specifically, the amplifiers 408_1, 408_4, 408_5, 408_8 in conjunction with the inductive elements 402*a*-402*d* form the substantially 8-shaped geometry winding that is used as the first primary circuit of a magnetically coupled active transformer to combine the output power of the four amplifiers 408_1, 408_4, 408_5, 408_8. The amplifiers 408_2, 408_3, 408_6, 408_7 in conjunction with the inductive elements 404*a*-404*d* form the substantially 8-shaped geometry winding that is used as the second primary circuit of a magnetically coupled active transformer to combine the output power of the four amplifiers 408_2, 408_3, 408_6, 408_7. Then, a uniform cyclic current A8 (i.e., the arrows as shown in FIG. 4) at the fundamental frequency around the first substantially 8-shaped geometry winding is generated and the uniform cyclic current results in a strong magnetic flux through the first substantially 8-shaped geometry winding, and a uniform cyclic current A9 (i.e., the arrows as shown in FIG. 4) at the fundamental frequency around the second substantially 8-shaped geometry winding is generated and the uniform cyclic current results in a strong magnetic flux through the second substantially 8-shaped geometry winding.

Then, the electromagnetic (EM) field components generated by the currents A8 and A9 will induce a current A10 (i.e., the arrows as shown in FIG. 4) to flow through the substantially 8-shaped geometry secondary winding 406. Since the direction of the currents A8 and A9 flowing in the first cyclic geometry windings 4022 and 4042 is counterclockwise and the direction of the currents A8 and A9 flowing in the second cyclic geometry windings 4024 and 4044 is clockwise, the direction of the EM field components emanating in the space inside the first cyclic geometry windings 4022 and 4042 will point substantially outward from the surface, and the direction of the EM field components emanating in the space inside the second cyclic geometry windings 4024 and 4044 will point substantially inward from the surface as shown by the conventional notations (i.e., the first axis 4030 and the second axis 4032) in the middle of the first cyclic geometry winding 4022 and the second cyclic geometry winding 4024 respectively. In other words, the direction of the EM field components emanating in the space inside the first cyclic geometry windings 4022 is opposite to the direction of the EM field components emanating in the space inside the second cyclic geometry winding 4024. Moreover, the EM field components emanating at a certain distance from the first cyclic geometry winding 4022 and the second cyclic geometry winding 4024 also have opposite directions and tend to counteract each other. As a result, by making the first cyclic geometry winding 4022 and the second cyclic geometry winding 4024 substantially symmetrical, and making the first cyclic geometry winding 4042 and the second cyclic geometry winding 4044 substantially symmetrical, the far field generated by the first substantially 8-shaped geometry primary winding 402 and the second substantially 8-shaped geometry primary winding 404 can be largely cancelled by itself while the first substantially 8-shaped geometry primary winding 402 and the second substantially 8-shaped geometry primary winding 404 can still induce the current A10 to flow through the substantially 8-shaped geometry secondary winding 406 for amplifying the input signal Si4 to generate the output signal So4.

In this exemplary embodiment, the first substantially 8-shaped geometry primary winding 402, the second substantially 8-shaped geometry primary winding 404, and the substantially 8-shaped geometry secondary winding 406 are implemented on the same metal layer in the chip. However, the crossing area between the first cyclic geometry winding 4022 and the second cyclic geometry winding 4024, the crossing area between the first cyclic geometry winding 4042 and the second cyclic geometry winding 4044, the crossing area between the first cyclic geometry winding 4062 and the second cyclic geometry winding 4064 (i.e., the portion labeled as 4095), and the crossing areas labeled as 4096, 4097 can be routed to different metal layers to avoid the contact of the two different windings. In short, the metal layers on which the first substantially 8-shaped geometry primary winding 402, the second substantially 8-shaped geometry primary winding 404, and the substantially 8-shaped geometry secondary winding 406 are routed depend upon design requirements. In addition, it should be noted that the layout design shown in FIG. 4 is for illustrative purposes only, and is not meant to be a limitation of the present invention. That is, other alternative layout designs obeying the spirit of the present invention still fall within the scope of the present invention. Moreover, a plurality of center taps CT4*a*-CT4*d* may be added to the connections 4091-4094 respectively as shown in FIG. 4, and the functions of the center taps have been described in the above embodiment, thus the detailed description is omitted here for brevity. It should be noted that another center tap(s) (not shown) may be arranged to couple to the substantially middle position of the substantially 8-shaped geometry secondary winding 406 to provide a DC voltage.

Figure 5:
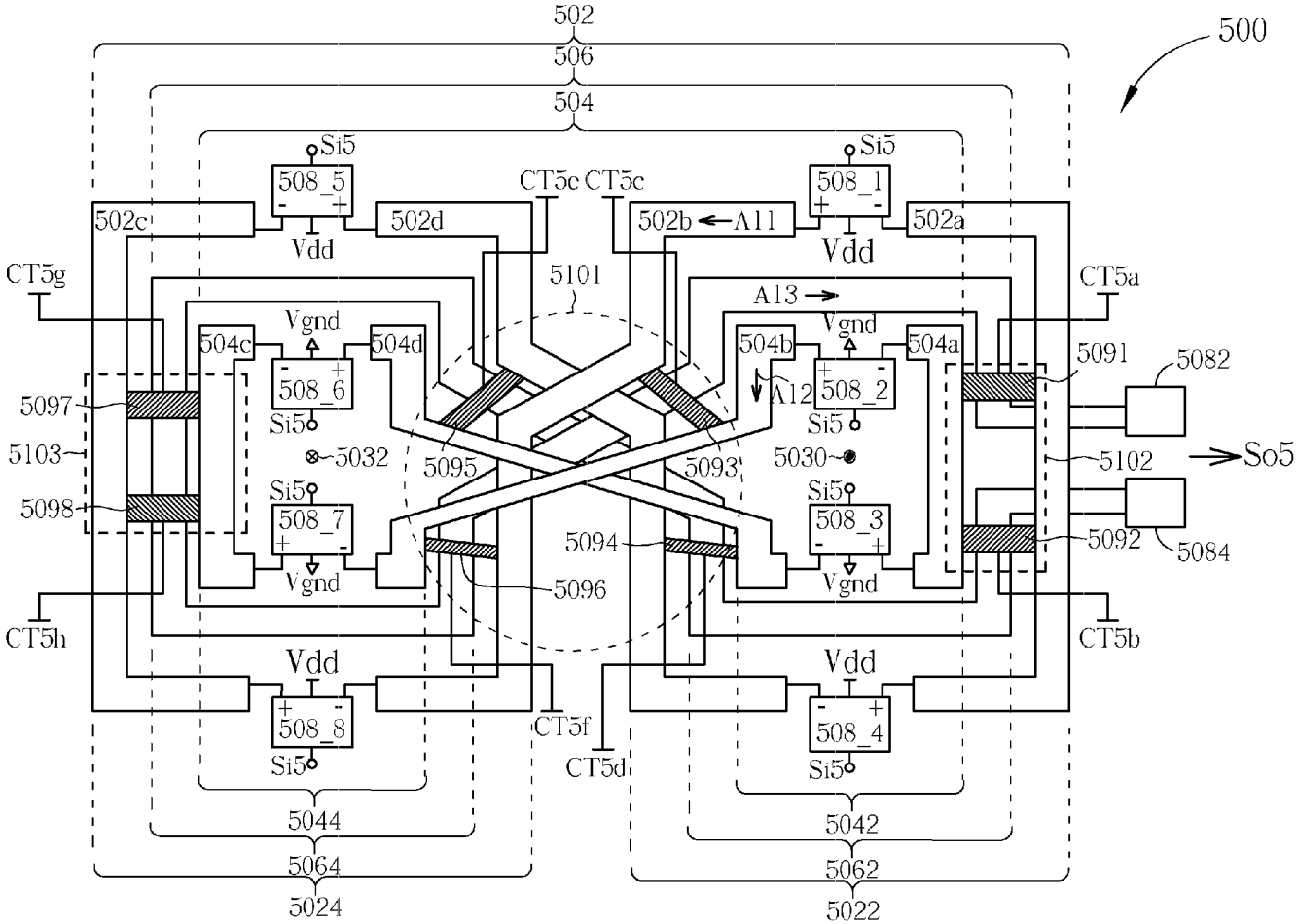
FIG. 5 is a diagram illustrating a signal transforming circuit according to a fifth exemplary embodiment of the present invention.

Please refer to FIG. 5. FIG. 5 is a diagram illustrating a signal transforming circuit 500 according to a fifth exemplary embodiment of the present invention. The signal transforming circuit 500 can be utilized to amplify an input signal Si5 with an input power into an output signal So5 with an output power, therefore the signal transforming circuit 500 can also named as a distributed active transformer (DAT) power amplifier. The signal transforming circuit 500 comprises a first substantially 8-shaped geometry primary winding 502, a second substantially 8-shaped geometry primary winding 504, a substantially 8-shaped geometry secondary winding 506, and a plurality of amplifiers 508_1-508_8 receiving the input signal Si5. It should be noted that, the configuration of amplifier pairs (e.g., the amplifiers 508_1-508_2, 508_3-508_4, 508_5-508_6, 508_7-508_8) are similar to the amplifiers 308_1-308_2 as shown in FIG. 3B-3C, therefore the detailed description of the amplifier pairs is omitted here for brevity.

The first substantially 8-shaped geometry primary winding 502 comprises a first cyclic geometry winding 5022 and a second cyclic geometry winding 5024, wherein the first cyclic geometry winding 5022 and the second cyclic geometry winding 5024 are comprised of a plurality of inductive elements 502*a*-502*d*. The inductive element 502*a* and the inductive element 502*b* are coupled to an output port of the amplifier 508_1. The inductive element 502*a* and the inductive element 502*d* are coupled to an output port of the amplifier 508_4. The inductive element 502*c* and the inductive element 502*d* are coupled to an output port of the amplifier 508_5. The inductive element 502*c* and the inductive element 502*b* are coupled to an output port of the amplifier 508_8.

The second substantially 8-shaped geometry primary winding 504 comprises a first cyclic geometry winding 5042 and a second cyclic geometry winding 5044, wherein the first cyclic geometry winding 5042 and the second cyclic geometry winding 5044 are comprised of a plurality of inductive elements 504*a*-504*d*. The inductive element 504*a* and the inductive element 504*b* are coupled to an output port of the amplifier 508_2. The inductive element 504*a* and the inductive element 504*d* are coupled to an output port of the amplifier 508_3. The inductive element 504*c* and the inductive element 504*d* are coupled to an output port of the amplifier 508_6. The inductive element 504*c* and the inductive element 504*b* are coupled to an output port of the amplifier 508_7.

As shown in FIG. 5, the first cyclic geometry winding 5022 having a shape centered about a first axis 5030 is formed by the inductive element 502*a*, a partial of the inductive element 502*b*, and a partial of the inductive element 502*d*. The second cyclic geometry winding 5024 having a shape centered about a second axis 5032 is formed by the inductive element 502*c*, a partial of the inductive element 502*d*, and a partial of the inductive element 502*b*. In addition, the first cyclic geometry winding 5022 and the second cyclic geometry winding 5024 are arranged to form the first substantially 8-shaped geometry primary winding 502 such that a magnetic field emanated by the first cyclic geometry winding 5022 mutually electromagnetically couples with a magnetic field emanated by the second cyclic geometry winding 5024.

The first cyclic geometry winding 5042 having a shape centered about the first axis 5030 is formed by the inductive element 504*a*, a partial of the inductive element 504*b*, and a partial of the inductive element 504*d*. The second cyclic geometry winding 5044 having a shape centered about the second axis 5032 is formed by the inductive element 504*c*, a partial of the inductive element 504*d*, and a partial of the inductive element 504*b*. In addition, the first cyclic geometry winding 5042 and the second cyclic geometry winding 5044 are arranged to form the second substantially 8-shaped geometry primary winding 504 such that a magnetic field emanated by the first cyclic geometry winding 5042 mutually electromagnetically couples with a magnetic field emanated by the second cyclic geometry winding 5044.

Furthermore, the substantially 8-shaped geometry secondary winding 506 comprises a first cyclic geometry winding 5062 and a second cyclic geometry winding 5064. As shown in FIG. 5, the first cyclic geometry winding 5062 is arranged to have a shape centered about the first axis 5030, and the second cyclic geometry winding 5064 is arranged to have a shape centered about the second axis 5032. Furthermore, the first cyclic geometry winding 5062 and the second cyclic geometry winding 5064 are arranged to form the substantially 8-shaped geometry secondary winding 506. In addition, the substantially 8-shaped geometry secondary winding 506 further comprises a first port 5082 and a second port 5084 arranged to generate the output signal So5 according to the input signal Si5. Specifically, the substantially 8-shaped geometry secondary winding 506 disposed adjacent to the first substantially 8-shaped geometry primary winding 502 and the second substantially 8-shaped geometry primary winding 504 to magnetically couple to the first substantially 8-shaped geometry primary winding 502 and the second substantially 8-shaped geometry primary winding 504 to generate the output signal So5 at the first port 5082 and the second port 5084.

In addition, each amplifier of the plurality of amplifiers 508_1-508_8 is a push-pull amplifier having a positive output terminal (+) and a negative output terminal (−), wherein the positive output terminal (+) and are negative output terminal (−) coupled to the respective inductive element as shown in FIG. 5. Furthermore, each amplifier of the plurality of amplifiers 508_1-508_8 has an input port receiving the input signal Si5. It should be noted that the input signal Si5 is a differential input signal and therefore each of the input ports is a differential input port having a positive input terminal and a negative input terminal (not shown). In addition, each amplifier of the amplifiers 508_1, 508_4, 508_5, 508_8 has a common mode terminal coupled to the supply voltage Vdd, and each amplifier of the amplifiers 508_2, 508_3, 508_6, 508_7 has a common mode terminal coupled to the ground voltage Vgnd as shown in FIG. 5.

Furthermore, the signal transforming circuit 500 further comprises a plurality of connections 5091-5098 (i.e., the oblique line inductive elements). Specifically, the first connections of the connection 5091 and 5092 are attached to the inductive element 502*a*, and the second connections of the connection 5091 and 5092 are attached to the inductive element 504*a*, wherein the first connection of the connection 5091 and the first connection of the 5092 are each located at a position on the first cyclic geometry winding 5022 such that the first connection of the connection 5091 and the first connection of the 5092 are each symmetrically distant from a point where a voltage waveform of a fundamental frequency of oscillation is at or near a minimum magnitude (e.g., a virtual ground); and the second connection of the connection 5091 and the second connection of the 5092 are each located at a position on the first cyclic geometry winding 5022 such that the second connection of the connection 5091 and the second connection of the 5092 are each symmetrically distant from a point where a voltage waveform of a fundamental frequency of oscillation is at or near a minimum magnitude (e.g., a virtual ground).

The first connections of the connection 5093 and 5094 are attached to the inductive element 502*b*, and the second connections of the connection 5093 and 5094 are attached to the inductive element 504*b*, wherein the first connection of the connection 5093 and the first connection of the 5094 are each located at a position on the first cyclic geometry winding 5022 such that the first connection of the connection 5093 and the first connection of the 5094 are each symmetrically distant from a point where a voltage waveform of a fundamental frequency of oscillation is at or near a minimum magnitude (e.g., a virtual ground); and the second connection of the connection 5093 and the second connection of the 5094 are each located at a position on the first cyclic geometry winding 5022 such that the second connection of the connection 5093 and the second connection of the 5094 are each symmetrically distant from a point where a voltage waveform of a fundamental frequency of oscillation is at or near a minimum magnitude (e.g., a virtual ground).

The first connections of the connection 5095 and 5096 are attached to the inductive element 502*d*, and the second connections of the connection 5095 and 5096 are attached to the inductive element 504*d*, wherein the first connection of the connection 5095 and the first connection of the connection 5096 are each located at a position on the first cyclic geometry winding 5024 such that the first connection of the connection 5095 and the first connection of the 5096 are each symmetrically distant from a point where a voltage waveform of a fundamental frequency of oscillation is at or near a minimum magnitude (e.g., a virtual ground); and the second connection of the connection 5095 and the second connection of the 5096 are each located at a position on the first cyclic geometry winding 5024 such that the second connection of the connection 5095 and the second connection of the 5096 are each symmetrically distant from a point where a voltage waveform of a fundamental frequency of oscillation is at or near a minimum magnitude (e.g., a virtual ground).

The first connections of the connections 5097 and 5098 are attached to the inductive element 502*c*, and the second connections of the connections 5097 and 5098 are attached to the inductive element 504*c*, wherein the first connection of the connection 5097 and the first connection of the connection 5098 are each located at a position on the first cyclic geometry winding 5024 such that the first connection of the connection 5097 and the first connection of the connection 5098 are each symmetrically distant from a point where a voltage waveform of a fundamental frequency of oscillation is at or near a minimum magnitude (e.g., a virtual ground); and the second connection of the connection 5097 and the second connection of the connection 5098 are each located at a position on the first cyclic geometry winding 5024 such that the second connection of the connection 50975 and the second connection of the connection 5098 are each symmetrically distant from a point where a voltage waveform of a fundamental frequency of oscillation is at or near a minimum magnitude (e.g., a virtual ground).

More specifically, the connection 5091 is arranged to conduct a dc current from the supply voltage Vdd of the amplifier 508_1 to the ground voltage Vgnd of the amplifier 508_2. The connection 5092 is arranged to conduct a dc current from the supply voltage Vdd of the amplifier 508_4 to the ground voltage Vgnd of the amplifier 508_3. The connection 5093 is arranged to conduct a dc current from the supply voltage Vdd of the amplifier 508_1 to the ground voltage Vgnd of the amplifier 508_2. The connection 5094 is arranged to conduct a dc current from the supply voltage Vdd of the amplifier 508_4 to the ground voltage Vgnd of the amplifier 508_3. The connection 5095 is arranged to conduct a dc current from the supply voltage Vdd of the amplifier 508_5 to the ground voltage Vgnd of the amplifier 508_6. The connection 5096 is arranged to conduct a dc current from the supply voltage Vdd of the amplifier 508_8 to the ground voltage Vgnd of the amplifier 508_7. The connection 5097 is arranged to conduct a dc current from the supply voltage Vdd of the amplifier 508_5 to the ground voltage Vgnd of the amplifier 508_6. The connection 5098 is arranged to conduct a dc current from the supply voltage Vdd of the amplifier 508_8 to the ground voltage Vgnd of the amplifier 508_7. Accordingly, a benefit of making the supply connections in this way is that the dc current consumed by the amplifiers on the first substantially 8-shaped geometry primary winding 502 is shared with the amplifiers on the second substantially 8-shaped geometry primary winding 504.

According to the topology of the first substantially 8-shaped geometry primary winding 502 and the second substantially 8-shaped geometry primary winding 504, when the input signal Si5 is inputted to the amplifiers 508_1-508_8, each distributed amplifier is able to create an individual radiating RF power outputs. Then, by appropriately tuning the impedance matching condition between the output port of each amplifier and the corresponding inductive element and the phases of the input signal Si5, the power outputs can be combined to provide a single output that is essentially the sum of the individual power outputs. More specifically, the amplifiers 508_1, 508_4, 508_5, 508_8 in conjunction with the inductive elements 502*a*-502*d* form the substantially 8-shaped geometry winding that is used as the first primary circuit of a magnetically coupled active transformer to combine the output power of the four amplifiers 508_1, 508_4, 508_5, 508_8. The amplifiers 508_2, 508_3, 508_6, 508_7 in conjunction with the inductive elements 504*a*-504*d* form the substantially 8-shaped geometry winding that is used as the second primary circuit of a magnetically coupled active transformer to combine the output power of the four amplifiers 508_2, 508_3, 508_6, 508_7. Then, a uniform cyclic current A11 (i.e., the arrows as shown in FIG. 5) at the fundamental frequency around the first substantially 8-shaped geometry winding 502 is generated and the uniform cyclic current A11 results in a strong magnetic flux through the first substantially 8-shaped geometry winding 502, and a uniform cyclic current A12 (i.e., the arrows as shown in FIG. 5) at the fundamental frequency around the second substantially 8-shaped geometry winding 504 is generated and the uniform cyclic current A12 results in a strong magnetic flux through the second substantially 8-shaped geometry winding 504.

The electromagnetic (EM) field components generated by the currents A11 and A12 will induce a current A13 (i.e., the arrows as shown in FIG. 5) to flow through the substantially 8-shaped geometry secondary winding 506. Since the direction of the currents A11 and A12 flowing in the first cyclic geometry windings 5022 and 5042 is counterclockwise and the direction of the currents A11 and A12 flowing in the second cyclic geometry windings 5024 and 5044 is clockwise, the direction of the EM field components emanating in the space inside the first cyclic geometry windings 5022 and 5042 will point substantially outward from the surface, and the direction of the EM field components emanating in the space inside the second cyclic geometry windings 5024 and 5044 will point substantially inward from the surface as shown by the conventional notations (i.e., the first axis 5030 and the second axis 5032) in the middle of the first cyclic geometry winding 5022 and the second cyclic geometry winding 5024 respectively. In other words, the direction of the EM field components emanating in the space inside the first cyclic geometry windings 5022 is opposite to the direction of the EM field components emanating in the space inside the second cyclic geometry winding 5024. Moreover, the EM field components emanating at a certain distance from the first cyclic geometry winding 5022 and the second cyclic geometry winding 5024 also have opposite directions and tend to counteract each other. As a result, by making the first cyclic geometry winding 5022 and the second cyclic geometry winding 5024 substantially symmetrical, and making the first cyclic geometry winding 5042 and the second cyclic geometry winding 5044 substantially symmetrical, the far field generated by the first substantially 8-shaped geometry primary winding 502 and the second substantially 8-shaped geometry primary winding 504 can be largely cancelled by itself while the first substantially 8-shaped geometry primary winding 502 and the second substantially 8-shaped geometry primary winding 504 can still induce the current A13 to flow through the substantially 8-shaped geometry secondary winding 506 for amplifying the input signal Si5 to generate the output signal So5.

In this exemplary embodiment, the first substantially 8-shaped geometry primary winding 502, the second substantially 8-shaped geometry primary winding 504, and the substantially 8-shaped geometry secondary winding 506 are implemented on the same metal layer in the chip. However, the crossing area between the first cyclic geometry winding 5022 and the second cyclic geometry winding 5024, the crossing area between the first cyclic geometry winding 5042 and the second cyclic geometry winding 5044, the crossing area between the first cyclic geometry winding 5062 and the second cyclic geometry winding 5064 (i.e., the portion labeled as 5101), and the crossing areas labeled as 5102, 5103 can be routed to different metal layers to avoid the contact of the two different windings. In short, the metal layers on which the first substantially 8-shaped geometry primary winding 502, the second substantially 8-shaped geometry primary winding 504, and the substantially 8-shaped geometry secondary winding 506 are routed depend upon design requirements. In addition, it should be noted that the layout design shown in FIG. 5 is for illustrative purposes only, and is not meant to be a limitation of the present invention. That is to say, other alternative layout designs obeying the spirit of the present invention still fall within the scope of the present invention. Moreover, a plurality of center CT5*a*-CT5*h* taps may be added to the connections 5091-5098 respectively as shown in FIG. 5, and the functions of the center taps have been described in the above embodiment, thus the detailed description is omitted here for brevity. It should be noted that another center tap(s) (not shown) may be arranged to couple to the substantially middle position of the substantially 8-shaped geometry secondary winding 506 to provide a DC voltage.

Figure 6:
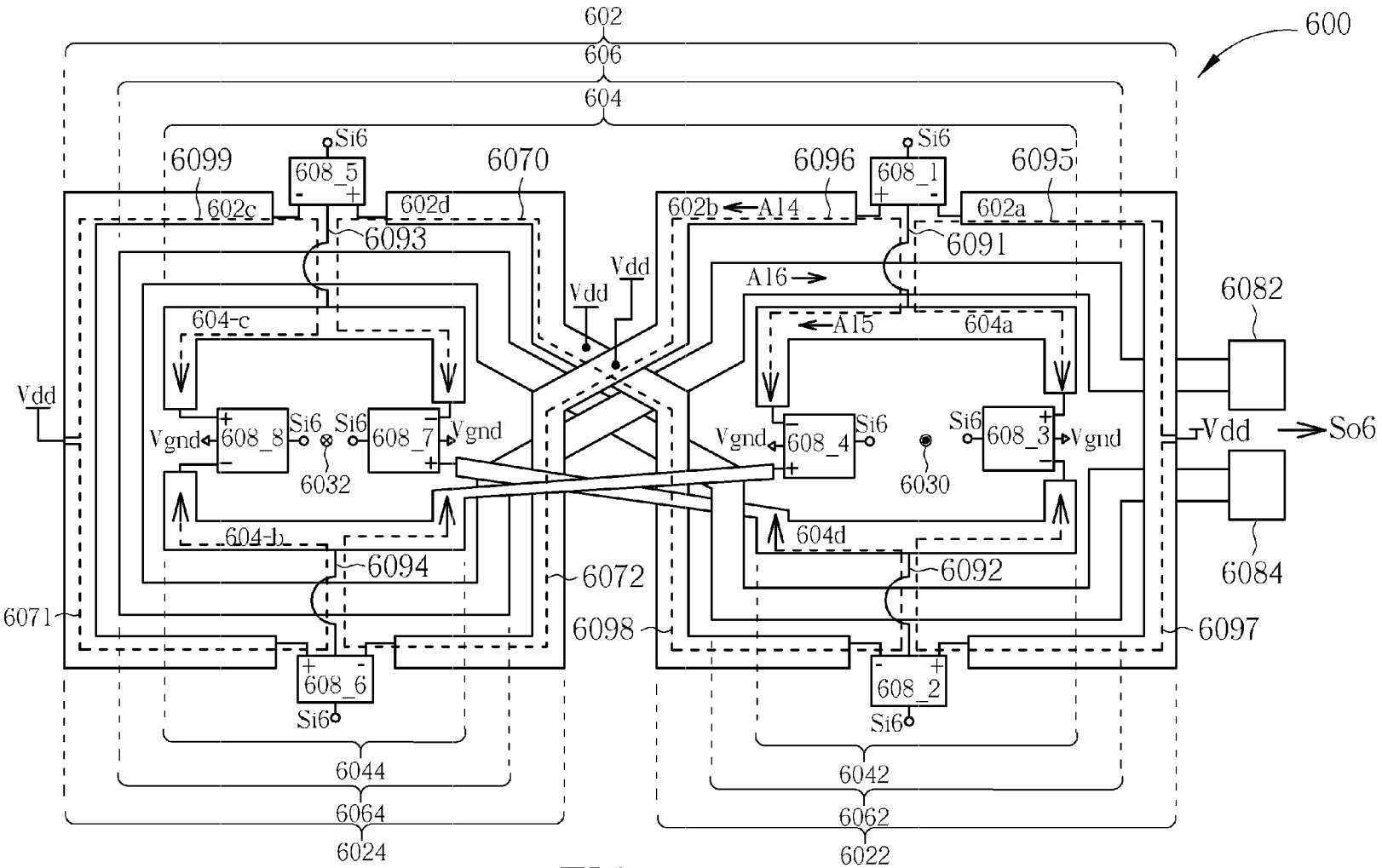
FIG. 6 is a diagram illustrating a signal transforming circuit according to a sixth exemplary embodiment of the present invention.

Please refer to FIG. 6. FIG. 6 is a diagram illustrating a signal transforming circuit 600 according to a sixth exemplary embodiment of the present invention. The signal transforming circuit 600 can be utilized to amplify an input signal Si6 with an input power into an output signal So6 with an output power; therefore the signal transforming circuit 600 can also be called a distributed active transformer (DAT) power amplifier. The signal transforming circuit 600 comprises a first substantially 8-shaped geometry primary winding 602, a second substantially 8-shaped geometry primary winding 604, a substantially 8-shaped geometry secondary winding 606, and a plurality of amplifiers 608_1-608_8 receiving the input signal Si6. It should be noted that, in this embodiment, the configuration of amplifier (e.g., the amplifiers 608_1, 608_2, 608_5, 608_6) are similar to the amplifier 308_1 as shown in FIG. 3B, and the configuration of amplifier (e.g., the amplifiers 608_3, 608_4, 608_7, 608_8) are similar to the amplifier 308_1 as shown in FIG. (C). In other words, the amplifiers 608_1, 608_2, 608_5, 608_6 are P-type complementary amplifier having P-type transistor pair for receiving the input signal Si6, and the amplifiers 608_3, 608_4, 608_7, 608_8 are P-type complementary amplifier having P-type transistor pair for receiving the input signal Si6.

The first substantially 8-shaped geometry primary winding 602 comprises a first cyclic geometry winding 6022 and a second cyclic geometry winding 6024, wherein the first cyclic geometry winding 6022 and the second cyclic geometry winding 6024 are comprised of a plurality of inductive elements 602*a*-602*d*. The inductive element 602*a* and the inductive element 602*b* are coupled to an output port of the amplifier 608_1. The inductive element 602*a* and the inductive element 602*d* are coupled to an output port of the amplifier 608_2. The inductive element 602*c* and the inductive element 602*d* are coupled to an output port of the amplifier 608_5. The inductive element 602*c* and the inductive element 602*b* are coupled to an output port of the amplifier 608_6.

The second substantially 8-shaped geometry primary winding 604 comprises a first cyclic geometry winding 6042 and a second cyclic geometry winding 6044, wherein the first cyclic geometry winding 6042 and the second cyclic geometry winding 6044 are comprised of a plurality of inductive elements 604*a*-604*d*. The inductive element 604*a* and the inductive element 604*b* are coupled to an output port of the amplifier 608_3. The inductive element 604*a* and the inductive element 604*d* are coupled to an output port of the amplifier 608_3. The inductive element 604*c* and the inductive element 604*b* are coupled to an output port of the amplifier 608_7. The inductive element 604*c* and the inductive element 604*b* are coupled to an output port of the amplifier 608_8.

As shown in FIG. 6, the first cyclic geometry winding 6022 having a shape centered about a first axis 6030 is formed by the inductive element 602*a*, a partial of the inductive element 602*b*, and a partial of the inductive element 602*d*. The second cyclic geometry winding 6024 having a shape centered about a second axis 6032 is formed by the inductive element 602*c*, a partial of the inductive element 602*d*, and a partial of the inductive element 602*b*. In addition, the first cyclic geometry winding 6022 and the second cyclic geometry winding 6024 are arranged to form the first substantially 8-shaped geometry primary winding 602 such that a magnetic field emanated by the first cyclic geometry winding 6022 mutually electromagnetic couples with a magnetic field emanated by the second cyclic geometry winding 6024.

The first cyclic geometry winding 6042 having a shape centered about the first axis 6030 is formed by the inductive element 604*a* and a partial of the inductive element 604*d*. The second cyclic geometry winding 6044 having a shape centered about the second axis 6032 is formed by the inductive element 604*c* and a partial of the inductive element 604*b*. In addition, the first cyclic geometry winding 6042 and the second cyclic geometry winding 6044 are arranged to form the second substantially 8-shaped geometry primary winding 604 such that a magnetic field emanated by the first cyclic geometry winding 6042 mutually electromagnetic couples with a magnetic field emanated by the second cyclic geometry winding 6044.

Furthermore, the substantially 8-shaped geometry secondary winding 606 comprises a first cyclic geometry winding 6062 and a second cyclic geometry winding 6064. As shown in FIG. 6, the first cyclic geometry winding 6062 is arranged to have a shape centered about the first axis 6030, and the second cyclic geometry winding 6064 is arranged to have a shape centered about the second axis 6032. Furthermore, the first cyclic geometry winding 6062 and the second cyclic geometry winding 6064 are arranged to form the substantially 8-shaped geometry secondary winding 606. In addition, the substantially 8-shaped geometry secondary winding 606 further comprises a first port 6082 and a second port 6084 arranged to generate the output signal So6 according to the input signal Si6. Specifically, the substantially 8-shaped geometry secondary winding 606 is disposed adjacent to the first substantially 8-shaped geometry primary winding 602 and the second substantially 8-shaped geometry primary winding 604 to magnetically couple to the first substantially 8-shaped geometry primary winding 602 and the second substantially 8-shaped geometry primary winding 604 to generate the output signal So6 at the first port 6082 and the second port 6084.

In addition, as shown in FIG. 3B and FIG. 3C, each amplifier of the plurality of amplifiers 608_1-608_8 is a push-pull amplifier having a positive output terminal (+) and a negative output terminal (−), wherein the positive output terminal (+) and negative output terminal (−) are coupled to their respective inductive element as shown in FIG. 6. Furthermore, each amplifier of the plurality of amplifiers 608_1-608_8 has an input port receiving the input signal Si6. It should be noted that the input signal Si6 is a differential input signal and therefore each of the input ports is a differential input port having a positive input terminal and a negative input terminal (not shown). In addition, the supply voltage Vdd is supplied to the substantially middle positions (i.e., center tap) on the inductive elements 602*a*, 602*b*, 602*c*, and 602*d* respectively. Each amplifier of the amplifiers 608_3, 608_4, 608_7, 608_8 has a common mode terminal coupled to the ground voltage Vgnd as shown in FIG. 6. It should be noted that another center tap(s) (not shown) may be arranged to couple to the substantially middle position of the substantially 8-shaped geometry secondary winding 606 to provide a DC voltage.

Furthermore, the signal transforming circuit 600 further comprises a plurality of connections 6091-6098. Specifically, the connection 6091 is coupled between the common voltage of the amplifier 608_1 and the cyclic geometry winding 6042, and the connection 6091 is at a location on the cyclic geometry winding 6042 where a voltage waveform of a fundamental frequency of oscillation is at or near a minimum; and the connection 6092 is between the amplifier 608_2 and the cyclic geometry winding 6042, and the connection 6092 is at a location on the cyclic geometry winding 6042 where the voltage waveform of the fundamental frequency of oscillation is at or near the minimum. The connection 6093 is coupled between the common voltage of the amplifier 608_5 and the cyclic geometry winding 6044, and the connection 6093 is at a location on the cyclic geometry winding 6044 where a voltage waveform of a fundamental frequency of oscillation is at or near a minimum; and the connection 6094 is between the amplifier 608_6 and the cyclic geometry winding 6044, and the connection 6094 is at a location on the cyclic geometry winding 6044 where the voltage waveform of the fundamental frequency of oscillation is at or near the minimum.

More specifically, when the signal transforming circuit 600 is under operation, the connection 6091 is arranged to conduct a dc current (i.e., the dashed line arrow 6095) from the supply voltage Vdd of the inductive element 602*a* to the ground voltage Vgnd of the amplifier 608_2, and to conduct a dc current (i.e., the dashed line arrow 6096) from the supply voltage Vdd of the inductive element 602*b* to the ground voltage Vgnd of the amplifier 608_4. The connection 6092 is arranged to conduct a dc current (i.e., the dashed line arrow 6097) from the supply voltage Vdd of the inductive element 602*a* to the ground voltage Vgnd of the amplifier 608_3, and to conduct a dc current (i.e., the dashed line arrow 6098) from the supply voltage Vdd of the inductive element 602*d* to the ground voltage Vgnd of the amplifier 608_4. The connection 6093 is arranged to conduct a dc current (i.e., the dashed line arrow 6099) from the supply voltage Vdd of the inductive element 602*c* to the ground voltage Vgnd of the amplifier 608_8, and to conduct a dc current (i.e., the dashed line arrow 6070) from the supply voltage Vdd of the inductive element 602*d* to the ground voltage Vgnd of the amplifier 608_7. The connection 6094 is arranged to conduct a dc current (i.e., the dashed line arrow 6071) from the supply voltage Vdd of the inductive element 602*c* to the ground voltage Vgnd of the amplifier 608_8, and to conduct a dc current (i.e., the dashed line arrow 6072) from the supply voltage Vdd of the inductive element 602*b* to the ground voltage Vgnd of the amplifier 608_7. Accordingly, a benefit of making the supply connections in this way is that the dc current consumed by the amplifiers on the first substantially 8-shaped geometry primary winding 602 is shared with the amplifiers on the second substantially 8-shaped geometry primary winding 604.

According to the topology of the first substantially 8-shaped geometry primary winding 602 and the second substantially 8-shaped geometry primary winding 604, when the input signal Si6 is inputted to the amplifiers 608_1-608_8, each distributed amplifier is able to create an individual radiating RF power outputs. Then, by appropriately tuning the impedance matching condition between the output port of each amplifier and the corresponding inductive element and the phases of the input signal Si6, the power outputs can be combined to provide a single output that is essentially the sum of the individual power outputs. More specifically, the amplifiers 608_1, 608_2, 608_5, 608_6 in conjunction with the inductive elements 602*a*-602*d* form the substantially 8-shaped geometry winding that is used as the first primary circuit of a magnetically coupled active transformer to combine the output power of the four amplifiers 608_1, 608_2, 608_5, 608_6. The amplifiers 608_3, 608_4, 608_7, 608_8 in conjunction with the inductive elements 604*a*-604*d* form the substantially 8-shaped geometry winding that is used as the second primary circuit of a magnetically coupled active transformer to combine the output power of the four amplifiers 608_3, 608_4, 608_7, 608_8. Then, a uniform cyclic current A14 (i.e., the arrows as shown in FIG. 6) at the fundamental frequency around the first substantially 8-shaped geometry winding 602 is generated and the uniform cyclic current A14 results in a strong magnetic flux through the first substantially 8-shaped geometry winding 602, and a uniform cyclic current A15 (i.e., the arrows as shown in FIG. 6) at the fundamental frequency around the second substantially 8-shaped geometry winding 604 is generated and the uniform cyclic current A15 results in a strong magnetic flux through the second substantially 8-shaped geometry winding 604.

The electromagnetic (EM) field components generated by the currents A14 and A15 will induce a current A16 (i.e., the arrows as shown in FIG. 6) to flow through the substantially 8-shaped geometry secondary winding 606. Since the direction of the currents A14 and A15 flowing in the first cyclic geometry windings 6022 and 6042 is counterclockwise and the direction of the currents A14 and A15 flowing in the second cyclic geometry windings 6024 and 6044 is clockwise, the direction of the EM field components emanating in the space inside the first cyclic geometry windings 6022 and 6042 will point substantially outward from the surface, and the direction of the EM field components emanating in the space inside the second cyclic geometry windings 6024 and 6044 will point substantially inward from the surface as shown by the conventional notations (i.e., the first axis 6030 and the second axis 6032) in the middle of the first cyclic geometry winding 6022 and the second cyclic geometry winding 6024 respectively. In other words, the direction of the EM field components emanating in the space inside the first cyclic geometry windings 6022 is opposite to the direction of the EM field components emanating in the space inside the second cyclic geometry winding 6024. Moreover, the EM field components emanating at a certain distance from the first cyclic geometry winding 6022 and the second cyclic geometry winding 6024 also have opposite directions and tend to counteract each other. As a result, by making the first cyclic geometry winding 6022 and the second cyclic geometry winding 6024 substantially symmetrical, and making the first cyclic geometry winding 6042 and the second cyclic geometry winding 6044 substantially symmetrical, the far field generated by the first substantially 8-shaped geometry primary winding 602 and the second substantially 8-shaped geometry primary winding 604 can be largely cancelled by itself while the first substantially 8-shaped geometry primary winding 602 and the second substantially 8-shaped geometry primary winding 604 can still induce the current A16 to flow through the substantially 8-shaped geometry secondary winding 606 for amplifying the input signal Si6 to generate the output signal So6.

In this exemplary embodiment, the first substantially 8-shaped geometry primary winding 602, the second substantially 8-shaped geometry primary winding 604, and the substantially 8-shaped geometry secondary winding 606 are implemented on the same metal layer in the chip. However, the crossing area between the first cyclic geometry winding 6022 and the second cyclic geometry winding 6024, the crossing area between the first cyclic geometry winding 6042 and the second cyclic geometry winding 6044, the crossing area between the first cyclic geometry winding 6062 and the second cyclic geometry winding 6064 (i.e., the portion labeled as 6101). In short, the metal layers on which the first substantially 8-shaped geometry primary winding 602, the second substantially 8-shaped geometry primary winding 604, and the substantially 8-shaped geometry secondary winding 606 are routed depend upon design requirements. In addition, it should be noted that the layout design shown in FIG. 6 is for illustrative purposes only, and is not meant to be a limitation of the present invention. That is, other alternative layout designs obeying the spirit of the present invention still fall within the scope of the present invention.

Briefly, by forming the primary winding(s) and the secondary winding wind of the above signal transforming circuit to be the substantially 8-shaped geometry, the far field generated by the primary winding(s) can be greatly cancelled by itself while the primary winding(s) still can induce the output current to flow through the secondary winding disposed adjacent to the primary winding(s) for transforming/amplifying the input signal to generate the output signal.

Those skilled in the art will readily observe that numerous modifications and alterations of the device and method may be made while retaining the teachings of the invention.

What is claimed is:

1. A signal transforming circuit, comprising:

a first substantially 8-shaped geometry primary winding, arranged to couple a first input signal; and a substantially 8-shaped geometry secondary winding, having a first port and a second port, the substantially 8-shaped geometry secondary winding disposed adjacent to the first substantially 8-shaped geometry primary winding to magnetically couple to the first substantially 8-shaped geometry primary winding for generating an output signal at the first port and the second port;

wherein at least one of the first substantially 8-shaped geometry primary winding and the substantially 8-shaped geometry secondary winding comprises a crossing area routed to different metal layers to avoid contact of the first substantially 8-shaped geometry primary winding and the substantially 8-shaped geometry secondary winding.

2. The signal transforming circuit of claim 1, further comprising:

a center tap, arranged to couple to the first substantially 8-shaped geometry primary winding for providing a DC (Direct Current) voltage for the first substantially 8-shaped geometry primary winding.

3. The signal transforming circuit of claim 1, further comprising:

a center tap, arranged to couple to the substantially 8-shaped geometry secondary winding for providing a DC voltage for the substantially 8-shaped geometry secondary winding.

4. A signal transforming circuit, comprising:

a first substantially 8-shaped geometry primary winding, arranged to couple a first input signal; and a substantially 8-shaped geometry secondary winding, having a first port and a second port, the substantially 8-shaped geometry secondary winding disposed adjacent to the first substantially 8-shaped geometry primary winding to magnetically couple to the first substantially 8-shaped geometry primary winding for generating an output signal at the first port and the second port;

wherein the first substantially 8-shaped geometry primary winding comprises:

a first port;

a second port, wherein the first port and the second port of the first substantially 8-shaped geometry primary winding are coupled for the first input signal;

a first cyclic geometry winding, having a shape centered about a first axis; and a second cyclic geometry winding, having a shape centered about a second axis, wherein the first cyclic geometry winding and the second cyclic geometry winding are arranged to form the first substantially 8-shaped geometry primary winding such that a magnetic field emanated by the first cyclic geometry winding mutually electromagnetic couples with a magnetic field emanated by the second cyclic geometry winding; and the substantially 8-shaped geometry secondary winding comprises:

a third cyclic geometry winding, having a shape centered about the first axis; and a fourth cyclic geometry winding, having a shape centered about the second axis, wherein the third cyclic geometry winding and the fourth cyclic geometry winding are arranged to form the substantially 8-shaped geometry secondary winding;

wherein the first and third cyclic geometry windings are symmetrical about the first axis, and the second and fourth cyclic geometry windings are symmetrical about the second axis.

5. The signal transforming circuit of claim 4, wherein the first axis is different from the second axis.

6. A signal transforming circuit, comprising:

a first substantially 8-shaped geometry primary winding, arranged to couple a first input signal;

a substantially 8-shaped geometry secondary winding, having a first port and a second port, the substantially 8-shaped geometry secondary winding disposed adjacent to the first substantially 8-shaped geometry primary winding to magnetically couple to the first substantially 8-shaped geometry primary winding for generating an output signal at the first port and the second port; and a second substantially 8-shaped geometry primary winding, arranged to couple a second input signal;

wherein the substantially 8-shaped geometry secondary winding is disposed adjacent to the second substantially 8-shaped geometry primary winding to magnetically couple to the second substantially 8-shaped geometry primary winding for generating the output signal at the first port and the second port of the substantially 8-shaped geometry secondary winding.

7. The signal transforming circuit of claim 6, further comprising:

a center tap, arranged to couple to the second substantially 8-shaped geometry primary winding for providing a DC voltage for the second substantially 8-shaped geometry primary winding.

8. The signal transforming circuit of claim 6, wherein a phase of the first input signal substantially equals a phase of the second input signal.

9. A signal transforming circuit, comprising:

a first substantially 8-shaped geometry primary winding, arranged to couple a first input signal;

a substantially 8-shaped geometry secondary winding, having a first port and a second port, the substantially 8-shaped geometry secondary winding disposed adjacent to the first substantially 8-shaped geometry primary winding to magnetically couple to the first substantially 8-shaped geometry primary winding for generating an output signal at the first port and the second port;

at least one first amplifier receiving the first input signal; and at least one second amplifier receiving the first input signal;

wherein the first substantially 8-shaped geometry primary winding comprises:

a first cyclic geometry winding having at least one first inductive element coupled to an output port of the first amplifier in series, the first cyclic geometry winding having a shape centered about a first axis; and a second cyclic geometry winding having at least one second inductive element coupled to an output port of the second amplifier in series, the second cyclic geometry winding having a shape centered about a second axis, the first cyclic geometry winding and the second cyclic geometry winding are arranged to form the first substantially 8-shaped geometry primary winding such that a magnetic field emanated by the first cyclic geometry winding mutually electromagnetic couples with a magnetic field emanated by the second cyclic geometry winding; and the substantially 8-shaped geometry secondary winding comprises:

a third cyclic geometry winding, having a shape centered about the first axis; and a fourth cyclic geometry winding, having a shape centered about the second axis, wherein the third cyclic geometry winding and the fourth cyclic geometry winding are arranged to form the substantially 8-shaped geometry secondary winding.

10. The signal transforming circuit of claim 9, wherein the first axis is different from the second axis.

11. The signal transforming circuit of claim 9, further comprising:

a second substantially 8-shaped geometry primary winding, arranged to couple a second input signal;

wherein the substantially 8-shaped geometry secondary winding is disposed adjacent to the second substantially 8-shaped geometry primary winding to magnetically couple to the second substantially 8-shaped geometry primary winding to generate the output signal at the first port and the second port of the substantially 8-shaped geometry secondary winding.

12. A signal transforming circuit, comprising:

a first substantially 8-shaped geometry primary winding, arranged to couple a first input signal; and a substantially 8-shaped geometry secondary winding, having a first port and a second port, the substantially 8-shaped geometry secondary winding disposed adjacent to the first substantially 8-shaped geometry primary winding to magnetically couple to the first substantially 8-shaped geometry primary winding for generating an output signal at the first port and the second port;

wherein the first substantially 8-shaped geometry primary winding comprises a first cyclic geometry winding and a second cyclic geometry winding arranged to couple the first input signal, the signal transforming circuit further comprises:

a second substantially 8-shaped geometry primary winding, comprising a third cyclic geometry winding and a fourth cyclic geometry winding to couple the second input signal;

at least one first connection, arranged to couple between the first cyclic geometry winding and the third cyclic geometry winding; and at least one second connection, arranged to couple between the second cyclic geometry winding and the fourth cyclic geometry winding.

13. The signal transforming circuit of claim 12, further comprising:

a center tap, arranged to couple to the first connection for providing a DC voltage for the first connection.

14. The signal transforming circuit of claim 12, further comprising:

a center tap, arranged to couple to the second connection for providing a DC voltage for the second connection.

15. The signal transforming circuit of claim 12, wherein the first substantially 8-shaped geometry primary winding further comprises:

at least one first amplifier and at least one second amplifier, arranged to receive the first input signal; and the first cyclic geometry winding has at least one first inductive element coupled to an output port of the first amplifier in series, the second cyclic geometry winding has at least one second inductive element coupled to an output port of the second amplifier in series, the first cyclic geometry winding and the second cyclic geometry winding are arranged to form the first substantially 8-shaped geometry primary winding.

16. The signal transforming circuit of claim 15, wherein the second substantially 8-shaped geometry primary winding further comprises:

at least one third amplifier and at least one fourth amplifier, arranged to receive the second input signal; and the third cyclic geometry winding has at least one third inductive element coupled to an output port of the third amplifier in series, the fourth cyclic geometry winding has at least one fourth inductive element coupled to an output port of the fourth amplifier in series, the third cyclic geometry winding and the fourth cyclic geometry winding are arranged to form the second substantially 8-shaped geometry primary winding.

17. The signal transforming circuit of claim 16, wherein the first connection is attached to the first inductive element at a position on the first cyclic geometry winding where a voltage waveform of a fundamental frequency is at a minimum, and the second connection is attached to the second inductive element at a position on the second cyclic geometry winding where the voltage waveform of the fundamental frequency is at a minimum.

18. The signal transforming circuit of claim 17, wherein the first connection is attached to the third inductive element at a position on the third cyclic geometry winding where the voltage waveform of the fundamental frequency is at a minimum, and the second connection is attached to the fourth inductive element at a position on the fourth cyclic geometry winding where the voltage waveform of the fundamental frequency is at a minimum.

19. The signal transforming circuit of claim 16, wherein a first specific connection and a second specific connection of the first connection are attached to the first inductive element, and the first specific connection and the second specific connection are each located at a position on the first cyclic geometry winding such that the first specific connection and the second specific connection are each symmetrically distant from a point where a voltage waveform of a fundamental frequency of oscillation is at or near a minimum magnitude; and a third specific connection and a fourth specific connection of the second connection are attached to the second inductive element, and the third specific connection and the fourth specific connection are each located at a position on the second cyclic geometry winding such that the third specific connection and the fourth specific connection are each symmetrically distant from a point where the voltage waveform of the fundamental frequency of oscillation is at or near the minimum magnitude.

20. The signal transforming circuit of claim 19, wherein the first specific connection and the second specific connection are attached to the third inductive element, and the first specific connection and the second specific connection are each located at a position on the third cyclic geometry winding such that the first specific connection and the second specific connection are each symmetrically distant from a point where a voltage waveform of the fundamental frequency of oscillation is at or near the minimum magnitude; and the third specific connection and the fourth specific connection are attached to the fourth inductive element, and the third specific connection and the fourth specific connection are each located at a position on the fourth cyclic geometry winding such that the third specific connection and the fourth specific connection are each symmetrically distant from a point where the voltage waveform of the fundamental frequency of oscillation is at or near the minimum magnitude.

21. The signal transforming circuit of claim 16, wherein the first connection conducts a dc current from the first amplifier to the third amplifier, and the second connection conducts a dc current from the second amplifier to the fourth amplifier.

22. The signal transforming circuit of claim 16, wherein the first connection is between the first amplifier and the third cyclic geometry winding, and the first connection is at a location on the third cyclic geometry winding where a voltage waveform of a fundamental frequency of oscillation is at or near a minimum; and the second connection is between the second amplifier and the fourth cyclic geometry winding, and the second connection is at a location on the fourth cyclic geometry winding where the voltage waveform of the fundamental frequency of oscillation is at or near the minimum.

23. A signal transforming circuit, comprising:

a first substantially 8-shaped geometry primary winding, comprising a first cyclic geometry winding and a second cyclic geometry winding arranged to couple a first input signal;

a substantially 8-shaped geometry secondary winding, comprising a third cyclic geometry winding and a fourth cyclic geometry winding;

a second substantially 8-shaped geometry primary winding, comprising a fifth cyclic geometry winding and a sixth cyclic geometry winding arranged to couple a second input signal;

at least one first connection, arranged to couple between the first cyclic geometry winding and the fifth cyclic geometry winding; and at least one second connection, arranged to couple between the second cyclic geometry winding and the sixth cyclic geometry winding;

wherein the substantially 8-shaped geometry secondary winding is arranged to magnetically couple to the first substantially 8-shaped geometry primary winding and the second substantially 8-shaped geometry primary winding to generate an output signal.

24. The signal transforming circuit of claim 23, further comprising:

a center tap, arranged to couple to the first connection for providing a DC voltage for the first connection.

25. The signal transforming circuit of claim 23, further comprising:

a center tap, arranged to couple to the second connection for providing a DC voltage for the second connection.

26. The signal transforming circuit of claim 23, wherein the first substantially 8-shaped geometry primary winding further comprises:

at least one first amplifier and at least one second amplifier, arranged to receive the first input signal; and the first cyclic geometry winding has at least one first inductive element coupled to an output port of the first amplifier in series, the second cyclic geometry winding has at least one second inductive element coupled to an output port of the second amplifier in series, the first cyclic geometry winding and the second cyclic geometry winding are arranged to form the first substantially 8-shaped geometry primary winding.

27. The signal transforming circuit of claim 26, wherein the second substantially 8-shaped geometry primary winding further comprises:

at least one third amplifier and at least one fourth amplifier, arranged to receive the second input signal; and the fifth cyclic geometry winding has at least one third inductive element coupled to an output port of the third amplifier in series, the sixth cyclic geometry winding has at least one fourth inductive element coupled to an output port of the fourth amplifier in series, the fifth cyclic geometry winding and the sixth cyclic geometry winding are arranged to form the second substantially 8-shaped geometry primary winding.

28. The signal transforming circuit of claim 27, wherein the first connection is attached to the first inductive element at a position on the first cyclic geometry winding where a voltage waveform of a fundamental frequency is at a minimum, and the second connection is attached to the second inductive element at a position on the second cyclic geometry winding where the voltage waveform of the fundamental frequency is at a minimum.

29. The signal transforming circuit of claim 28, wherein the first connection is attached to the third inductive element at a position on the fifth cyclic geometry winding where the voltage waveform of the fundamental frequency is at a minimum, and the second connection is attached to the fourth inductive element at a position on the sixth cyclic geometry winding where the voltage waveform of the fundamental frequency is at a minimum.

30. The signal transforming circuit of claim 27, wherein a first specific connection and a second specific connection of the first connection are attached to the first inductive element, and the first specific connection and the second specific connection are each located at a position on the first cyclic geometry winding such that the first specific connection and the second specific connection are each symmetrically distant from a point where a voltage waveform of a fundamental frequency of oscillation is at or near a minimum magnitude; and a third specific connection and a fourth specific connection of the second connection are attached to the second inductive element, and the third specific connection and the fourth specific connection are each located at a position on the second cyclic geometry winding such that the third specific connection and the fourth specific connection are each symmetrically distant from a point where the voltage waveform of the fundamental frequency of oscillation is at or near the minimum magnitude.

31. The signal transforming circuit of claim 30, wherein the first specific connection and the second specific connection are attached to the third inductive element, and the first specific connection and the second specific connection are each located at a position on the fifth cyclic geometry winding such that the first specific connection and the second specific connection are each symmetrically distant from a point where a voltage waveform of the fundamental frequency of oscillation is at or near the minimum magnitude; and the third specific connection and the fourth specific connection are attached to the fourth inductive element, and the third specific connection and the fourth specific connection are each located at a position on the sixth cyclic geometry winding such that the third specific connection and the fourth specific connection are each symmetrically distant from a point where the voltage waveform of the fundamental frequency of oscillation is at or near the minimum magnitude.

32. The signal transforming circuit of claim 27, wherein the first connection conducts a dc current from the first amplifier to the third amplifier, and the second connection conducts a dc current from the second amplifier to the fourth amplifier.

33. The signal transforming circuit of claim 27, wherein the first connection is between the first amplifier and the fifth cyclic geometry winding, and the first connection is at a location on the fifth cyclic geometry winding where a voltage waveform of a fundamental frequency of oscillation is at or near a minimum; and the second connection is between the second amplifier and the sixth cyclic geometry winding, and the second connection is at a location on the sixth cyclic geometry winding where the voltage waveform of the fundamental frequency of oscillation is at or near the minimum.

* * * * *